US008918025B2

(12) United States Patent
Tohmatsu et al.

(10) Patent No.: US 8,918,025 B2
(45) Date of Patent: Dec. 23, 2014

(54) IMAGE FORMING METHOD AND IMAGE FORMING APPARATUS

(75) Inventors: Hiroshi Tohmatsu, Shizuoka (JP); Shigenori Yaguchi, Shizuoka (JP); Hitoshi Iwatsuki, Shizuoka (JP); Toyoaki Tano, Shizuoka (JP); Koichi Sakata, Shizuoka (JP); Mariko Takii, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 181 days.

(21) Appl. No.: 13/548,511

(22) Filed: Jul. 13, 2012

(65) Prior Publication Data

US 2013/0016999 A1 Jan. 17, 2013

(30) Foreign Application Priority Data

Jul. 15, 2011 (JP) ..... 2011-156768

(51) Int. Cl.
*G03G 15/08* (2006.01)

(52) U.S. Cl.
CPC ..... *G09G 15/0879* (2013.01)
USPC ..... 399/254; 399/252; 399/258

(58) Field of Classification Search
USPC ..... 399/252, 254, 258; 430/110.02
See application file for complete search history.

(56) References Cited

U.S. PATENT DOCUMENTS

2007/0020552 A1* 1/2007 Matsumoto et al. ..... 430/111.35
2007/0065742 A1* 3/2007 Ishizuka et al. ..... 430/106.1
2008/0081278 A1* 4/2008 Matsumoto et al. ..... 430/111.35
2008/0213684 A1 9/2008 Nagayama et al.
2008/0298866 A1 12/2008 Matsumoto et al.
2009/0028611 A1* 1/2009 Matsumoto et al. ..... 399/258
2009/0041510 A1* 2/2009 Imahashi et al. ..... 399/277
2009/0074450 A1 3/2009 Nagayama et al.
2010/0233613 A1 9/2010 Masuda et al.
2010/0239975 A1 9/2010 Yamaguchi et al.
2011/0065037 A1 3/2011 Iwatsuki et al.
2011/0086307 A1* 4/2011 Nakajima et al. ..... 430/111.3
2011/0171573 A1 7/2011 Sakata et al.
2011/0217649 A1 9/2011 Masuda et al.
2011/0229817 A1 9/2011 Yamada et al.
2012/0009518 A1 1/2012 Nagayama et al.
2012/0028183 A1 2/2012 Nakajima et al.
2012/0057898 A1 3/2012 Sakata et al.
2012/0058423 A1 3/2012 Yamaguchi et al.
2012/0064451 A1 3/2012 Kishida et al.
2012/0122027 A1* 5/2012 Watanabe et al. ..... 430/108.4

FOREIGN PATENT DOCUMENTS

JP 3734096 10/2005
JP 2008-299217 12/2008
JP 2010-190956 9/2010

* cited by examiner

*Primary Examiner* — Francis Gray
(74) *Attorney, Agent, or Firm* — Oblon, Spivak, McClelland, Maier & Neustadt, L.L.P.

(57) ABSTRACT

To provide an image forming method, containing: a charging step, a latent electrostatic image forming step, a developing step, a transferring step, and a fixing step, wherein the developing step is developing the latent electrostatic image formed on the latent electrostatic image bearing member with a two-component developer containing a toner and a carrier by a developing element to form a visible image, where the developing contains: stirring the toner and the carrier to prepare the two-component developer to have a flow energy amount of 30 mJ to 70 mJ; and periodically discharging and transporting the stirred two-component to the developer unit by air pressure to thereby supply the two-component developer for the developing.

8 Claims, 7 Drawing Sheets

IMAGE FORMING METHOD AND IMAGE FORMING APPARATUS

BACKGROUND OF THE INVENTION

1. Field of the Invention

The present invention relates to an image forming method and an image forming apparatus, and specially relates to an image forming method and an image forming apparatus, which can be applied for a printer or a photocopier using a two-component developer.

2. Description of the Related Art

According to an electrophotographic or electrostatic recording image forming method, a latent electrostatic image is formed on a latent electrostatic image bearing member such as a photoconductive material, the latent electrostatic image is developed by depositing a charged toner onto the latent electrostatic image to form a visible image (a toner image), the visible image is transferred to a recording medium, and the transferred visible image is fixed to thereby form an output image. After completing the developing operation of the developing step, the developer from which the toner has been consumed is collected, and then mixed and/or stirred with a supply toner to thereby return to a developing step.

The developer used for the aforementioned image forming method needs to maintain a constant toner density and charged amount to stably provide a toner image.

The toner density is adjusted with an amount of the toner supplied to compensate the toner consumed in the developing step. Moreover, the charge is adjusted with frictions, as it is applied by frictional electrification when the carrier and the toner are mixed.

Accordingly, the two-component developer consisting of the toner and the carrier is sufficiently stirred in the developing step, to equalize the toner density distribution, and to charge the toner, to thereby stabilize the toner image.

As illustrated in FIG. 10, in the conventional image forming method, dispersion and application of charge to the toner is performed by utilizing the stirring effect from the rotations of two screws 163, 164 in the developing element 150 during only a short period from the time when the toner enters into the developing element for supplying to the supplied toner is scoped and born on the developing sleeve. When the amount of the toner supplied is large to compensate the consumed toner, the supplied toner is scoped onto the developing sleeve without being sufficiently dispersed, which may cause problems in qualities of the resulting images, because of back ground deposition, and toner scattering.

To solve this problem, there is a method for enhancing the stirring by the rotations of the two screws.

When the stirring is enhanced, however, the stress applied to the developer increases, which may cause toner spent on the carrier after using a long period of time, and cracking of the carrier coat film (carrier coat layer), lowering the charge imparting ability.

There is disclosed a method for maintaining a constant toner density and charged amount without providing large stress to a developer, when a large amount of a toner is supplied to the developer, where the method uses a developing device, in which a stirring unit is separately provided outside a developing element, the developing element and the stirring unit are connected with a developer circulating unit, the stirring unit is configured to perform stirring depending on the condition of the developer with low stress, and the developer whose toner density and charged amount are appropriately adjusted is supplied to the developing element (see Japanese Patent (JP-B) No. 3734096, and Japanese Patent Application Laid-Open (JP-A) No. 2008-299217). In this method, the developer prepared (optimized) by the stirring unit is transferred (transported) to the developing element by air pressure while regulating the discharging amount of the developer with a rotary feeder.

In this method, however, air leakage through the developer increases when the developer has high flowability and a sufficient amount of the developer transferred cannot be secured, as the developer is transferred through the pipe by air pressure. Accordingly, there are variations in the amount of the developer transferred. To stably provide toner images, a constant amount of the developer needs to be continuously and effectively transferred to the developing element.

Accordingly, it is currently strongly desired to provide an image forming method, and image forming apparatus, by which a developer of a constant density, in which a toner and a carrier are uniformly mixed, can be prepared, an appropriate charge amount can be efficiently provided without providing stress to the developer, and a constant amount of the developer can be continuously, stably and effectively transported to a developing element.

The present invention aims to solve the aforementioned various problems in the art and to achieve the following object. An object of the present invention is to provide an image forming method and image forming apparatus, by which a developer of a constant density, in which a toner and a carrier are uniformly mixed, can be prepared, an appropriate charge amount can be efficiently provided without providing stress to the developer, and a constant amount of the developer can be continuously, stably and effectively transported to a developing element.

SUMMARY OF THE INVENTION

The means for solving the aforementioned problem is as follows.

The image forming method of the present invention contains:

charging a latent electrostatic image bearing member;

forming a latent electrostatic image on the charged latent electrostatic image bearing member;

developing the latent electrostatic image formed on the latent electrostatic image bearing member with a two-component developer by a developing element to form a visible image, where the two-component developer contains a toner and a carrier, and where the developing contains: stirring the toner and the carrier to prepare the two-component developer to have a flow energy amount of 30 mJ to 70 mJ; and periodically ejecting the stirred two-component developer and transporting the two-component developer to the developer element by air pressure to thereby supply the two-component developer for the developing;

transferring the visible image to a recording medium; and fixing the transferred visible image onto the recording medium, wherein the flow energy amount is a total energy amount attained from a sum of running torque and vertical load as measured by a powder rheometer containing a ventilation unit and a rotary wing, when the rotary wing rotates and enters the two-component developer packed in a container by 50 mm in the direction parallel to a rotational axis of the rotary wing with the top edge of the rotary having a peripheral velocity of 100 mm/sec, and the rotary wing having an entering angle of −10°, while ventilating at a ventilating rate of 0.8 mm/sec.

The present invention can solve the aforementioned various problems in the art, achieve the aforementioned object, and can provide an image forming method and image forming apparatus, by which a developer of a constant density, in which a toner and a carrier are uniformly mixed, can be prepared, an appropriate charge amount can be efficiently provided without providing stress to the developer, and a constant amount of the developer can be continuously, stably and effectively transported to a developing element.

Figure 1:
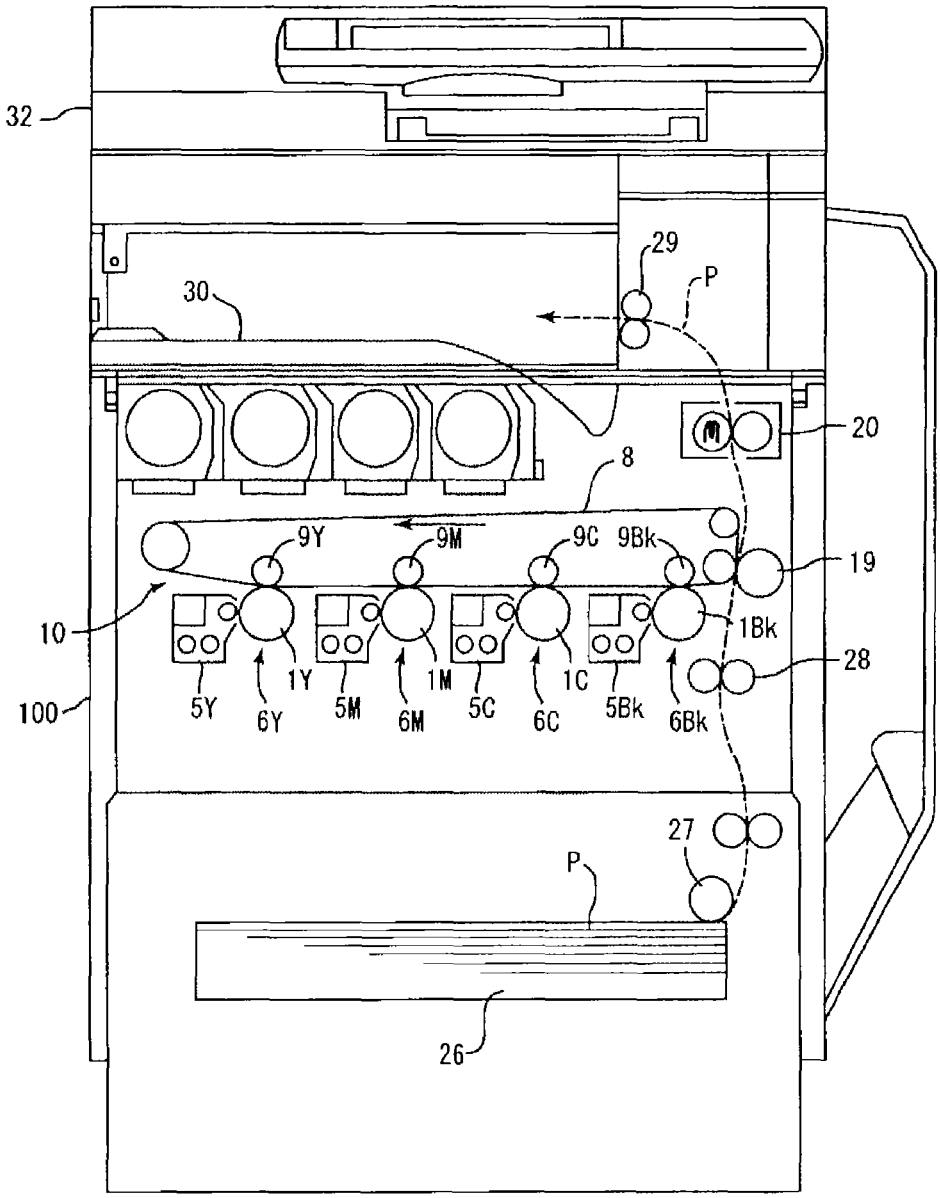
FIG. 1 is a schematic cross-sectional view illustrating one embodiment of the image forming apparatus of the present invention.

DETAILED DESCRIPTION OF THE INVENTION (Image Forming Method and Image Forming Apparatus)

The image forming method of the present invention contains at least a charging step, a latent electrostatic image forming step, a developing step, a transferring step, and a fixing step, and may further contain other steps, such as a diselectrification step, a cleaning step, a recycling step, and a controlling step, if necessary. The developing step contains a two-component developer preparing process, and a transporting process.

The image forming apparatus of the present invention contains at least a latent electrostatic image bearing member, a charging unit, a latent electrostatic image forming unit, a developing unit, a transferring unit, and a fixing unit, and may further contain other members, such as a diselectrification unit, a cleaning unit, a recycling unit, and a controlling unit, if necessary. The developing unit contains a two-component developer preparing element, a transporting element, and a developing element.

The charging step is suitably carried out by the charging unit; the latent electrostatic image forming step is suitably carried out by the latent electrostatic image forming unit; the developing step is suitably carried out by the developing unit; the transferring step is suitably carried out by the transferring unit; and the fixing step is suitably carried out by the fixing unit.

The image forming apparatus of the present invention will be specifically explained hereinafter, together with the explanation of the image forming method of the present invention.

<Charging Step and Charging Unit>

The charging step is charging the latent electrostatic image bearing member, and is suitably carried out by the charging unit. The charging of the latent electrostatic image bearing member can be performed by applying voltage to a surface of the latent electrostatic image bearing member.

The charging unit is appropriately selected depending on the intended purpose without any limitation, and examples thereof include: conventional contact charging units equipped with an electric conductive or semiconductive roller, brush, film or rubber blade; and non-contact chargers utilizing corona discharge such as corotron, and scorotron.

The shape of the charging unit may be in the shape of a magnetic brush or fur brush, other than the roller, and the shape thereof can be appropriately selected depending on the specification and configuration of the image forming apparatus.

In the case where a magnetic brush is used as the charging unit, for example, the magnetic brush using various ferrite particles such as Zn—Cu ferrite is used as a charging unit, and the magnetic brush is constructed of these ferrite particles, a non-magnetic electric conductive sleeve for supporting the ferrite particles, and a magnet roller provided inside the sleeve.

In the case where the fur brush is used as the charging unit, as for a material of the fur brush, for example, an electric conductive-processed fur with carbon, copper sulfide, metal or metal oxide is used, and the process fur is formed into a charging unit by winding the fur around a core bar, which is formed of a metal or is processed to have electric conductivity.

The charging unit is not limited to the contact charging unit, but the use of the contact charging unit is preferable as an image forming apparatus whose a generating amount of ozone is reduced is attained.

<Latent Electrostatic Image Forming Step, Latent Electrostatic Image Forming Unit>

The latent electrostatic image forming step is forming a latent electrostatic image on the latent electrostatic image bearing member charged in the charging step, and is suitably carried out by the latent electrostatic image forming unit.

A material, shape, structure, and size of the latent electrostatic image bearing member (may be also referred to as a "photoconductor" or "image bearing member" hereinafter) are appropriately selected from those known in the art without any limitation. As for the shape thereof, a drum shape is preferable. The material thereof includes, for example, an inorganic photoconductor such as amorphous silicon and selenium, and an organic photoconductor such as polysilane and phthalopolymethine. Among them, the amorphous silicon is preferable as it contributes to long service life of the resulting latent electrostatic image bearing member.

As for the amorphous silicon photoconductor, for example, a photoconductor having a photoconductive layer formed of a-Si (may also referred to as an "a-Si photoconductor" hereinafter), obtained by heating a substrate to 50° C. to 400° C., followed by forming the photoconductive layer on the substrate by a film forming method such as vacuum deposition, sputtering, ion plating, thermal CVD, photo CVD, and plasma CVD, can be used. Among them, the plasma CVD, i.e., a method where raw material gas is decomposed by DC, or high frequency microwave glow discharge, to deposit a-Si film on the substrate, is preferable.

The formation of the latent electrostatic image can be performed, for example, by exposing the surface of the photoconductor, which has been charged in the charging step, to light imagewise, and can be suitably carried out by the latent electrostatic image forming unit.

Examples of the latent electrostatic image forming unit include an exposure unit configured to expose a surface of the photoconductor to light imagewise.

The exposure unit is appropriately selected depending on the intended purpose without any limitation, provided that it can expose the charged surface of the photoconductor by the charging unit to light imagewise corresponding to an image to be formed. Examples thereof include various exposing devices, such as a reproduction optical exposing device, a rod-lens array exposing device, a laser optical exposure device, and a liquid crystal shutter optical device.

A light source used in the exposing unit is appropriately selected depending on the intended purpose without any limitation, and examples thereof include all luminous bodies such as fluorescent lamps, tungsten lamps, halogen lamps, mercury lamps, sodium lamps, light emitting diode (LED), laser diode (LD) (i.e. a semiconductor laser), and electroluminescence (EL).

Moreover, various filters may be used for applying only the light having the predetermined wavelength, and examples of the filters include a sharp-cut filter, a band-pass filter, a near IR-cut filter, a dichroic filter, an interference filter, and a color conversion filter.

The method of the present invention can also employ a back light system where the imagewise exposing is performed from the back side of the photoconductor.

<Developing Step, Developing Unit>

The developing step is developing the latent electrostatic image formed on the latent electrostatic image bearing member with a two-component developer containing a toner and a carrier in a developing element to thereby form a visible image, and is suitably carried out by the developing unit. The developing step contains at least a two-component developer preparing process and a transporting process, and may further contain other processes, if necessary.

The developing unit contains a two-component developer preparing element, a transporting element, and a developing element, and may further contain other members, if necessary.

The two-component developer preparing process is suitably carried out by the two-component developer preparing element, and the transporting process is suitably carried out by the transporting element.

<<Two-Component Developer Preparing Process, Two-Component Developer Preparing Element>>

The two-component developer preparing process is stirring the toner and carrier of the two-component developer (may also referred to as a "developer" hereinafter) to thereby prepare the two-component developer containing the toner and the carrier, and having the flow energy amount of 30 mJ to 70 mJ. The two-component developer preparing process is suitably carried out by the two-component developer preparing element.

In the present specification, the flow energy amount is an amount of energy for indicating a flow of the developer, and is a total energy amount attained from a sum of running torque and vertical load as measured by a powder rheometer containing a ventilation unit and a rotary wing, when the rotary wing rotates and enters the two-component developer packed in a container by 50 mm in the direction parallel to a rotational axis of the rotary wing with the top edge of the rotary having a peripheral velocity of 100 mm/sec, and the rotary wing having an entering angle of −10°, while ventilating at a ventilating rate of 0.8 mm/sec.

The flow energy amount is 30 mJ to 70 mJ, preferably 40 mJ to 70 mJ. When the flow energy amount is greater than 70 mJ, the flowability of the developer is low, which reduces contact probability of the developer with each other because of bad circulation of the developer in the stirring unit. As a result, a sufficient charging ability cannot be attained, large load is applied to the carrier because of the stress from stirring, which increases the stress to the developer, causing toner spent on the latent electrostatic image bearing member. When the flow energy amount is lower than 30 mJ, the flowability of the developer is high, which causes air leakage through the developer, varying the amount of the developer transferred in the transporting process. In addition, the developer may pass through the space between the latent electrostatic image bearing member and a cleaning blade, which may cause formation of defected images.

When the flow energy amount of the developer is in the range of 30 mJ to 70 mJ, it is preferable because the discharged amount of the developer is stabilized in the transporting process, which will be described later.

—Measuring Method of Flow—

The flow energy amount of the developer is measured by means of a powder rheometer in the following manner. In the present specification, as for the powder rheometer, FT4 (manufactured by Freeman Technology, Ltd.) is used.

The powder rheometer is a particle flow measuring device, which directly determines the flowability of the particles by measuring, at the same time, running torque and vertical load obtained by spiral rotations of the rotary wing in the packed particles. By measuring both the running torque and vertical load, the flowability of the particles, including characteristics of the powder itself, or influences from external environment, can be detected with high sensitivity. Since the measurement is performed on the packed particles the state of which has been made constant, moreover, data having excellent reproducibility can be attained.

Figure 8:
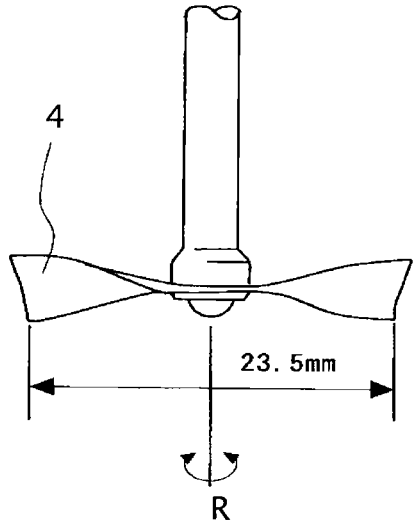
FIG. 8 is a schematic cross-sectional view illustrating one embodiment of a rotary wing for use in the measurement by the powder rheometer.

As for the rotary wing, a propeller-type wing as illustrated in FIG. 8 is used. Such rotary wing can be obtained from Freeman Technology, Ltd., and the rotary wing is preferably a 23.5 mm-diameter blade 4 in the shape of two-wing propeller provided from the rotational axis R as a center.

—Packing—

First, a split container is packed with the developer that is a subject of the measurement. As for the split container, there is used a separable container containing a first cylindrical container having the inner diameter of 25 mm, height of 59 mm, and volume of 25 mL, and a second cylindrical container having the inner diameter of 25 mm, and height of 22 mm, where the second container is placed on the first container, and the first and second containers are arranged separable. In the present specification, the height of the split container means the length in the direction parallel to the rotational axis.

When the split container is packed with the developer, it is important that it is packed with the developer as much amount as possible, as the bulk of the developer reduces in the conditioning, which will be described below.

Note that, it is preferred that the measurement is performed after standing the sample for 1 hour or longer in the environment having the temperature of 22° C. and relative humidity of 50%, so as not to generate any error in the measurement due to the external environmental factors.

—Conditioning—

Next, conditioning is preferably performed for the purpose of constantly equalize the flow state of the developer that is a subject of the measurement. To minimize the variation in the measured values (flow energy amount), it is important that a constant volume of the powder is always prepared. Accordingly, by performing conditioning, more stable measured values can be attained.

In the conditioning, the rotary wing is gently stirred in the rotational direction that hardly receives resistance from the developer to remove almost all the excessive air or partial stress, so as not to give stress to the developer packed in the split container, to thereby make the developer the equalized state.

The rotational direction that hardly receives resistance from the developer is a rotational direction opposite to a rotational direction at the time of the measurement, and is a clockwise direction as seeing the split container from a top (in the direction vertical to the rotational direction).

As for the specific conditions for conditioning, the developer is stirred with rotating the propeller-type rotary wing in the split container at the peripheral velocity (of the top edge of the rotary wing) of 40 mm/sec, and the entering angle (of the rotary wing) of +5°. Since the rotary wing moves up and down in the direction parallel to the rotational axis at the same time as rotating, the top edge of the rotary wing draws a spiral path.

The "entering angle" is an angle of the spiral path drawn by the top edge of the propeller-type rotary wing.

The number of the conditioning performed is 4 times.

After the conditioning, the top edge part of the second container of the split container is slowly moved, and the developer is leveled off at the height of the first container, 59 mm, to thereby obtain the developer having the volume of 25 mL. The obtained developer is moved to a third container having the inner diameter of 25 mm, height of 80 mm, and volume of 35 mL, which is used for the measurement.

It is preferred that at least one conditioning be performed in the third container under the same conditions (peripheral velocity of the top edge of the rotary wing: 40 mm/sec, entering angle of the rotary wing: +5°) to the above, before the measurement.

—Measurement of Flow Energy Amount—

Next, a ventilation unit is provided to the bottom surface of the third container, and the rotary wing is rotated with the peripheral velocity of the top edge of the rotary wing being 100 mm/sec, and entering angle of the rotary wing being −10°, while ventilating the air at the rate of 0.8 mm/sec. Under the conditions above, the rotary wing is entered (moved) into the developer packed in the third container by 50 mm in the direction parallel to the rotational axis of the rotational wing (the height direction of the third container), and the running torque and vertical load at the time of the entry (hereinafter, it may be referred to as "entry distance") are measured.

The rotational direction of the rotary wing is a direction opposite of the rotational direction for the conditioning, namely, an anti-clockwise direction as seeing the container from the top (in the direction vertical to the rotational direction).

The reason why the measurement is performed under the conditions such that the ventilation rate is set to 0.8 mm/sec, and the entering angle of the rotary wing is set to −10° is because it is tightly related to the transporting properties of the discharged developer to be transported to the developing element by air pressure in the transporting process, which will be described later, after the two-component developer preparing process.

Note that, as for the ventilation unit, a ventilation survey kit (manufactured by Freeman Technology, Ltd.) can be used.

A counting position of the entry distance (50 mm) of the rotary wing is appropriately selected depending on the intended purpose without any restriction. To the developer packed in the third container, the entry distance may be from the surface of the packed developer to the distance in the height direction (the direction parallel to the rotational axis) of the container, or may be from the position that is entered from the surface of the packed developer by a certain distance, to the distance in the height direction (the direction parallel to the rotational axis) of the container.

Figure 6A:
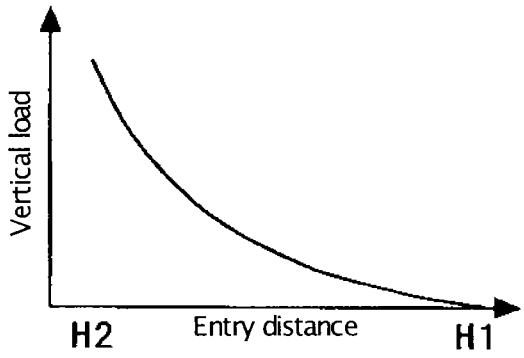
FIG. 6A is a schematic explanatory diagram illustrating one embodiment of a relationship between vertical load and entry distance as measured by a powder rheometer, in which the ordinate axis represents vertical load, and the transverse axis represents entry distance.

Next, the relationship between the entry distance and the vertical load or running torque will be explained with reference to the drawings. FIG. 6A is a schematic explanatory diagram illustrating one example of the relationship between the vertical load and entry distance as measured by a powder rheometer, and FIG. 6B is a schematic explanatory diagram illustrating one example of the relationship between the running torque and entry distance as measured by a powder rheometer.

Figure 6B:
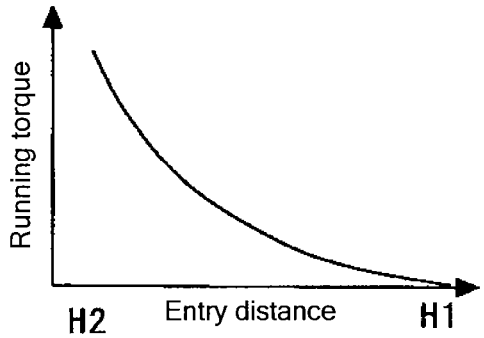
FIG. 6B is a schematic explanatory diagram illustrating one embodiment of a relationship between running torque and entry distance as measured by a powder rheometer, in which the ordinate axis represents running torque, and the transverse axis represents entry distance.

In FIGS. 6A and 6B, H1 denotes a counting position for the entry distance, and H2 denotes the entry distance (a reaching point of the rotary wing after entering, i.e., the position (depth) that is 50 mm from the counting position).

Figure 7:
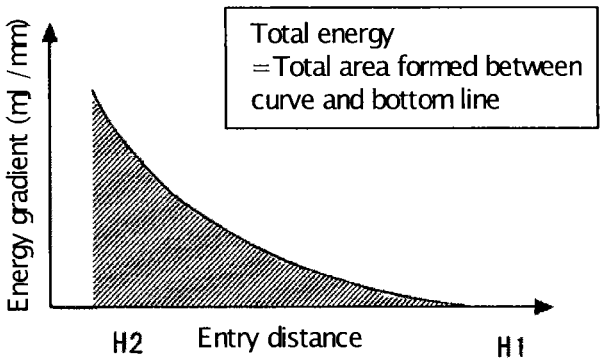
FIG. 7 is a schematic explanatory diagram illustrating one embodiment for determining a flow energy amount by means of a powder rheometer, in which the ordinate axis represents energy gradient (mJ/mm), and the transverse axis represents entry distance.

Moreover, FIG. 7 is a schematic explanatory diagram illustrating one example of a method for determining a flow energy amount by a powder rheometer, in which an energy gradient (mJ/mm) relative to the entry distance (depth) H is determined from the running torque and vertical load.

The area (area formed between the curve and the bottom line in FIG. 7 (a total area marked with slanted lines) obtained by integrating the energy gradient of FIG. 7 is a flow energy amount (mJ). In the present invention the flow energy amount (the total energy amount) is determined by integrating the section which is from 5 mm to 55 mm in height (height in the direction of the rotational axis) from the bottom surface of the third container.

Note that, in the present specification, the average values obtained by performing 5 cycles of the conditioning and the measurement of the flow energy amount is determined as a flow energy amount (mJ) for the purpose of reducing the influence from an error in the measuring method of the flowability.

The developer having the aforementioned flowability is prepared by stirring the toner and the carrier in the stirring element, which is separately provided from the developing element, and the prepared developer is periodically discharged from the stirring element, and transported to the developing element by the transporting process, which will be described later.

In the image forming method of the present invention, as the developer has the aforementioned flow energy amount and appropriate flowability, a sufficient charging ability can be imparted to the developer without varying in an amount of the developer to be transported in the transporting process, and without giving stress to the developer due to frictions or the like.

The stirring element is a member separately provided from the developing element. By providing the stirring element separately from the developing element, stress is not given to the developer even when a large amount of the toner is supplied, and therefore it is advantageous because the toner and the carrier can be sufficiently uniformly mixed without causing toner spent on the carrier by a long term usage, or cracking of the carrier coat layer, and without reducing the charging ability.

The outer part of the stirring element preferably has a supplying inlet for supplying the toner and carrier at the top and a discharging outlet for discharging the developer at the bottom.

Inside the stirring element, a transport screw for transporting the developer, a stirring member for stirring the developer, and a motor for rotating the stirring element and the transport screw, and a gear for controlling the rotation are preferably provided. The transport screw and stirring member are rotatable members.

The direction of helix of the transport screw and the rotational direction of the motor are designed to thereby send the developer upwards. The numbers of the transport screws, and location thereof are appropriately selected depending on the intended purpose without any limitation, but it is preferred that one transport screw be provided at a center of the stirring element.

The stirring member is a member provided not to be in contact with the transport screw, and examples thereof include a blade. The number, and location of the stirring element are appropriately selected depending on the intended purpose without any limitation, but it is preferred that a plurality of the stirring elements be rotatably provided along the inner wall.

Within the stirring element, the transport screw sends the developer up and down (the direction vertical to the rotational axis of the stirring element) relative to the stirring element, and the stirring member sends the developer in the circumferential direction of the stirring element. By using the shear force caused by these movements, and the shear force caused with the developer falling downwards due to gravity, equalization of the developer, effective optimization of the developer, and flowability of the developer before discharging are accelerated.

<<Transporting Process, Transporting Element>>

The transporting process is periodically discharging the stirred two-component developer after the two-component developer preparing process, and transporting the two-component developer to a developing element by air pressure. The transporting process is suitably performed by the transporting element.

The transporting element is appropriately selected depending on the intended purpose without any limitation, provided that it is capable of transporting the developer to the developing element, and examples thereof include a discharging outlet, a transporting pipe, and an air pump.

The developer prepared by the two-component developer preparing process is periodically discharged from the discharging outlet of the stirring element. The discharging outlet preferably has a member capable of regulating an amount of the developer to be discharged, and capable of continuously discharging a constant amount of the developer. The discharging outlet particularly preferably has a rotary feeder.

The rotary feeder is appropriately selected depending on the intended purpose without any limitation, and examples thereof include those described in JP-A No. 2008-299217.

The discharged developer is transported to the developing element through a transfer pipe connecting between the stirring unit and the developing element, by the air pressure of the air ejected from the air pump.

Since the developer has the flow energy amount of 30 mJ to 70 mJ in the image forming method of the present invention, the developer of a constant amount can be continuously stably and effectively transported to the developing element.

<<Developing Element>>

The developing element is configured to develop the latent electrostatic image bearing member with the developer transported in the transporting process to thereby form a visible image. The developing element employs a dry developing system.

The developing element preferably contains therein a transport screw configured to transport the developer, and a developing roller having a magnet. The developer transported inside the developing element by the transport screw is moved onto a surface of the photoconductor, by attraction force of the developing roller. As a result, the latent electrostatic image is developed with the toner, to thereby form a visible image formed of the toner on a surface of the photoconductor. The developer may be provided to the latent electrostatic image in a contact or non-contact manner.

In the conventional art, strong stirring is required to attain a homogenous developer and a sufficient charged amount thereof, when the toner and the carrier are mixed to be charged in the developing element. In accordance with the image forming method and image forming apparatus of the present invention, strong stirring is not required in a developing element, as a stirring unit and the developing element are separated. Accordingly, a sufficient charged amount is provided without giving stress to the developer, which is an advantageous.

<<Two-Component Developer>>

The two-component developer is a developer containing a carrier and a toner, and having the flow energy amount of 30 mJ to 70 mJ.

In the present specification, the "toner" denotes a group of toner particles, and the "carrier" denotes a group of carrier particles, unless otherwise stated.

—Carrier—

The carrier is appropriately selected depending on the intended purpose without any limitation, but the carrier is a carrier containing carrier particles, each of which contains a magnetic core, and a carrier coat layer provided on a surface of the core.

In the present specification, the "core" may denotes a single core particle, or a group of core particles, depending on the context.

—Core—

The core is appropriately selected depending on the intended purpose without any limitation, provided that it is a magnetic material. Examples of the core include: hard magnetic metal such as iron, and cobalt; iron oxide such as magnetite, hematite, and ferrite; various alloys or compounds; and resin particles in each of which any of these magnetic materials is dispersed. These may be used independently, or in combination.

Among them, Mn based ferrite, Mn—Mg based ferrite, and Mn—Mg—Sr ferrite are preferable in view of the environmental friendliness.

The component analysis of the ferrite particles can be performed by performing elemental analysis with fluorescent X-ray, and calculating a molar ratio of oxides from the result of the analysis.

The weight average particle diameter (Dw) of the core particles is appropriately selected depending on the intended purpose without any limitation, but it is preferably 20 μm to 65 μm. When the weight average particle diameter thereof is smaller than 20 μm, carrier depositions tend to occur. When the weight average particle diameter thereof is greater than 65 μm, carrier deposition are inhibited, but a toner does not accurately develop a latent electrostatic image, causing variation in the diameters of the developed dots and lowering granularity, or causing background deposition when the toner density is high.

The term "carrier deposition" means a phenomenon that a carrier is deposited on an image part or background part of a latent electrostatic image. The higher the electric fields thereof, more likely carrier deposition occurs. Since the electric field of the image part is weaken by the development with a toner, the carrier deposition is less likely to occur in the image part compared to the background part.

The weight average particle diameter (Dw) is calculated based on the particle size distribution (relationship between the number frequency and the diameter) of particles as measured based on numbers. In the present specification, the weight average particle diameter (Dw) is represented by the following formula (1):

$$Dw=\{1/\Sigma(nD^3)\}\times\{\Sigma(nD^4)\} \quad \text{Formula (1)}$$

In the formula (1), D denotes a representative particle diameter (μm) of particles present in each channel, and n denotes the total number of particles present in each channel.

Note that, the channel represents a length for dividing the range of the particle diameter to a measuring width unit in the particle size distribution diagram. In the present specification, the equal length (particle distribution width) of 2 μm is adapted as a channel. As for the representative particle diameter of the particles present in each channel, the lower limit of the particle diameters of the particles stored in each channel is adapted.

The shape of the core is appropriately selected depending on the intended purpose without any limitation, but it is preferably a particle having surface irregularities for realizing the numeral range of the flow energy amount of the two-component developer. More preferably, the shape thereof is 130 to 160 in the shape factor SF-2. When the SF-2 is lower than 130, the flow energy amount may be lower than 30 mJ. When the SF-2 is higher than 160, the flow energy amount may be greater than 70 mJ.

In the present specification, the shape factor SF-2 is determined as a value, obtained by randomly sampling 100 particles from the image of particles enlarged with magnification of ×300 using a field emission scanning electron microscope (FE-SEM) (e.g., S-800, manufactured by Hitachi, Ltd.), introducing the image information to an image analyzer (e.g., Luzex AP, NIRECO CORPORATION) to binarize the image data, and calculating from the following formula (2).

The shape factor SF-2 indicates the degree of surface irregularities of the particle. The value of the shape factor SF-2 increases when the degree of surface irregularities of the particle increases, and the closer the shape of the particle is to a complete round (sphere) the value thereof is closer to 100.

$$SF\text{-}2=(P^2/A)\times(1/4\pi)\times 100 \quad \text{Formula (2)}$$

In the formula (2), P is a boundary length of the shape obtained by projecting the core on the two dimensional plane, and A is a projected area of the core.

—Carrier Coat Layer—

The carrier coat layer contains at least a carrier coat resin, preferably further contains fillers, and may further contain other components, if necessary.

—Carrier Coat Resin—

The carrier coat resin is appropriately selected depending on the intended purpose without any limitation, and examples thereof include an acrylic resin, an amino resin, a polyvinyl-based resin, a polystyrene-based resin, a halogenated olefin resin, polyester, polycarbonate, polyethylene, polyvinyl fluoride, polyvinylidene fluoride, polyfluoroethylene, polyhexafluoropropylene, a vinylidene fluoride-vinyl fluoride copolymer, a fluoroterpolymers (e.g., a terpolymer of tetrafluoroethylene, vinylidene fluoride, and non-fluoromonomer), and a silicone resin. These may be used independently, or in combination.

Among them, a silicone resin, which is a resin having low surface energy, is preferable for preventing contamination with components of a toner.

A method for obtaining the silicone resin is appropriately selected depending on the intended purpose without any limitation, and the silicone resin may be appropriately synthesized for use, or selected from commercial products.

Examples of the commercial product of the silicone resin include: KR251, KR271, KR272, KR282, KR252, KR255, KR152, KR155, KR211, KR216, and KR213 (product names, all manufactured by Shin-Etsu Chemical Co., Ltd.); and AY42-170, SR2510, SR2400, SR2406, SR2410, SR2405, and SR2411 (product names, all manufactured by Dow Corning Toray Co., Ltd.).

As for the carrier coat resin, moreover, the copolymer represented by the general formula (1) is particularly preferable, as it is a resin having low surface energy and flexibility.

General Formula (1)

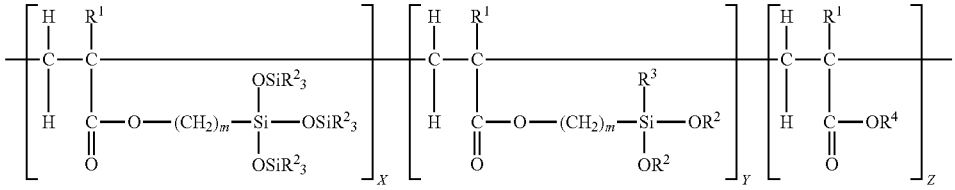

In the general formula (1), $R^1$ is a hydrogen atom or a methyl group; $R^2$ is a C1-C4 alkyl group; $R^3$ is a C1-C8 alkyl group or a C1-C4 alkoxy group; $R^4$ is a C1-C4 aliphatic hydrocarbon group or an alkyl group; m is an integer of 1 to 8; and X, Y, and Z each represent a molar ratio, where X is 10 mol % to 90 mol %, Y is 10 mol % to 90 mol %, Z is 30 mol % to 80 mol %, and a sum of Y and Z, i.e. (Y+Z), is greater than 60 mol %, but less than 90 mol %.

X is 10 mol % to 90 mol %, preferably 10 mol % to 40 mol %, and more preferably 20 mol % to 30 mol %.

Y is 10 mol % to 90 mol %, preferably 10 mol % to 80 mol %, and more preferably 15 mol % to 70 mol %.

Z is 30 mol % to 80 mol %, preferably 35 mol % to 75 mol %.

The copolymer represented by the general formula (1) is preferably a copolymer formed from monomers represented from the following general formulae (1-1), (1-2), and (1-3).

General Formula (1-1)

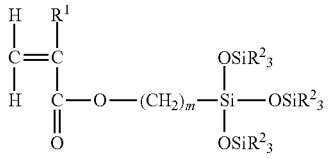

In the general formula (1-1), $R^1$ is a hydrogen atom or a methyl group; $R^2$ is a C1-C4 alkyl group, preferably at least one selected from the group consisting of a methyl group, an ethyl group, a propyl group, and a butyl group; m is an integer of 1 to 8, where —$(CH_2)_m$— is preferably an alkylene group such as a methylene group, an ethylene group, a propylene group, and a butylene group.

The monomer represented by the general formula (1-1) has, for example, an atom group, tris(trimethylsiloxy)silane, which has a large number of methyl groups in its side chains. In this case, the surface energy decreases as the molar ratio of the monomer represented by the general formula (1-1) increases relative to the entire resin, which reduces depositions of the resin component or releasing agent component of the toner.

When an amount of the monomer represented by the general formula (1-1) is less than 10 mol %, the sufficient effect thereof may not be attained, which may cause deposition of the toner components. When the amount thereof is greater than 40 mol %, the amount of the monomer represented by the general formula (1-2) reduces, which decreases the toughness of the resulting carrier coat layer, and reducing the adhesion between the core and the carrier coat layer to thereby lower the durability of the carrier coat layer.

Specific examples of the monomer represented by the general formula (1-1) include the following tris(trialkylsiloxy) silane compound. In the following tris(trialkylsiloxy)silane compound, Me represents a methyl group, Et represents an ethyl group, and Pr represents a propyl group.

$CH_2{=}CMe\text{-}COO{-}C_3H_6{-}Si(OSiMe_3)_3$
$CH_2{=}CH{-}COO{-}C_3H_6{-}Si(OSiMe_3)_3$
$CH_2{=}CMe\text{-}COO{-}C_4H_8{-}Si(OSiMe_3)_3$
$CH_2{=}CMe\text{-}COO{-}C_3H_6{-}Si(OSiEt_3)_3$
$CH_2{=}CH{-}COO{-}C_3H_6{-}Si(OSiEt_3)_3$
$CH_2{=}CMe\text{-}COO{-}C_4H_8{-}Si(OSiEt_3)_3$
$CH_2{=}CMe\text{-}COO{-}C_3H_6{-}Si(OSiPr_3)_3$
$CH_2{=}CH{-}COO{-}C_3H_6{-}Si(OSiPr_3)_3$
$CH_2{=}CMe\text{-}COO{-}C_4H_8{-}Si(OSiPr_3)_3$ General Formula (1-2)

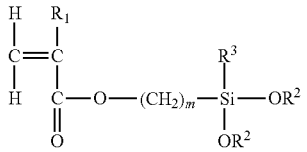

In the general formula (1-2), $R^1$ is a hydrogen atom or a methyl group.

$R^2$ is a C1-C4 alkyl group, preferably a methyl group, an ethyl group, a propyl group, or a butyl group.

$R^3$ is either a C1-C8 alkyl group, or a C1-C4 alkoxy group. The C1-C8 alkyl group is preferably a methyl group, an ethyl group, a propyl group, or a butyl group. The C1-C4 alkoxy group is preferably a methoxy group, an ethoxy group, a propoxy group, or a butoxy group.

"m" is an integer of 1 to 8, and "—$(CH_2)_m$—" is preferably an alkylene group, such as a methylene group, an ethylene group, a propylene group, and a butylene group.

When $R^3$ is an alkyl group, the monomer represented by the general formula (1-2) is a radically polymerizable bifunctional silane compound. The monomer represented by the general formula (1-2) is a trifunctional silane compound when $R^3$ is an alkoxy group.

When an amount of the monomer represented by the general formula (1-2) is less than 30 mol %, a sufficient toughness cannot be attained. When the amount thereof is greater than 80 mol %, the resulting carrier coat layer is hard and brittle, hence easily causing cracking of the film, the environmental property (humidity dependency) thereof may be degraded as the hydrolyzed crosslinking component is remained as large number of silanol groups.

Specific examples of the monomer represented by the general formula (1-2) include 3-methacryloxypropyltrimethoxysilane, 3-acryloxypropyltrimethoxysilane, 3-methacryloxypropyltriethoxysilane, 3-acryloxypropyltriethoxysilane, 3-methacryloxypropylmethyldimethoxysilane, 3-methacryloxypropylmethyldiethoxysilane, 3-methacryloxypropyltri(isopropoxy)silane, and 3-acryloxypropyltri(isopropyloxy) silane.

General Formula (1-3)

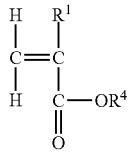

In the general formula (1-3), $R^1$ is a hydrogen atom or a methyl group.

$R^4$ is a C1-C4 aliphatic hydrocarbon group or an alkyl group, preferably an acryloyl group or a methacryloyl group.

The monomer represented by the general formula (1-3) is a radically polymerizable acrylic compound. When an amount of the monomer represented by the general formula (1-3) is less than 30 mol %, sufficient adhesion may not be attained. When the amount thereof is greater than 80 mol %, as either X or Y is 10 or lower, the resulting carrier coat resin layer may not be able to attain all of water-proofness, hardness, and flexibility (resistance to film cracking).

Among them, the monomer represented by the general formula (1-3) is preferably acrylic ester, or methacrylic ester, and specific examples thereof include methyl methacrylate, methyl acrylate, ethyl methacrylate, ethyl acrylate, butyl methacrylate, butyl acrylate, 2-(dimethylamino)ethyl methacrylate, 2-(dimethylamino)ethyl acrylate, 3-(dimethylamino)propyl methacrylate, 3-(dimethylamino)propyl acrylate, 2-(diethylamino)ethyl methacrylate, and 2-(diethylamino)ethyl acrylate. Among them, alkyl methacrylate is preferable, and methyl methacrylate is particularly preferable.

As for the amounts of the monomers of the general formulae (1-1), (1-2), and (1-3) in the copolymer represented by the general formula (1), the sum (Y+Z) of Y and Z is preferably in the range of greater than 60 mol % but lower than 90 mol %, more preferably in the range of greater than 70 mol % but lower than 85 mol %.

A molecular weight of the carrier coat resin is appropriately selected depending on the intended purpose without any limitation, but it is preferably 5,000 to 100,000 in the weight average molecular weight, more preferably 10,000 to 70,000, and even more preferably 30,000 to 40,000. When the weight average molecular weight thereof is smaller than 5,000, the strength of the resulting carrier coat resin layer may be insufficient. When the weight average molecular weight thereof is greater than 100,000, aggregation of particles and formation of an uneven resin layer tend to be caused in the case where the viscosity of the coating liquid is high and it is applied to the core having a small particle diameter, which may make difficult to produce a carrier coat layer.

The weight average molecular weight can be measured, for example, by measuring a tetrahydrofuran (THF) soluble component by gel permeation chromatography (GPC) under the following conditions.

Device (an example): HLC-8120 manufactured by TOSOH CORPORATION

Column (an example): TSKgelGMHXL (two): TSK gel Multipore HXL-M (one)

Sample solution: 0.25% by mass THF solution

Solution injection amount: 100 μL

Flow rate: 1 mL/min

Measuring temperature: 40° C.

Detection device: Refractive index detector

Standard material: 12 types (molecular weights: 500; 1,050; 2,800; 5,970; 9,100; 18,100; 37,900; 96,400; 190,000; 355,000; 1,090,000; and 2,890,000) of standard polystyrene of TOSOH CORPORATION (TSK standard POLYSTYRENE)

—Filler—

The carrier coat layer preferably contains filler for enhancing the strength thereof and adjusting the ohmic value of the carrier.

The filler is appropriately selected depending on the intended purpose without any limitation, and examples thereof include: metal or metal oxide powder such as ZnO, Al, and Ba; inorganic powder such as silica, alumina, titanium oxide, $SnO_2$ prepared by various methods, and $SnO_2$ doped with various elements; boride such as $TiB_2$, $ZnB_2$, and $MoB_2$; electric conductive polymers such as silicon carbide, polyacetylene, polyparaphenylene, poly(para-phenylene sulfide), polypyrrole, and polyaniline; and carbon black such as furnace black, acetylene black, and channel black. These may be used independently, or in combination.

Among them, the filler is preferably electric conductive particles, each containing a base formed of alumina, and an electric conductive coating layer formed on a surface of the base. When the filler is the electric conductive particles, the filler has high ability of adjusting the volume resistivity value of the carrier, and has high compatibility to a resin having a small surface energy, hence inhibiting the variation in the resistivity of the carrier over a long period of time.

The carrier with which the toner is charged by frictions has preferably a base having electronegativity that is far apart from that of the toner in view of charging ability. Since silica or titanium oxide used as additives of the toner has large electrone gravity and high negative chargeability, the carrier base itself is preferably an alumina base having a small electronegativity so that the charging ability increases, which is preferable in the case of a negatively charged toner.

An amount of the filler is appropriately selected depending on the particle diameter and specific surface area of the filler, but it is preferably 2% by mass to 500% by mass, more preferably 5% by mass to 400% by mass, relative to the carrier coat resin. When the amount of the filler is smaller than 2% by mass, the abrasion resistance of the carrier coat resin layer may not be sufficiently exhibited. When the amount thereof is greater than 500% by mass, the filler may be fallen off from the carrier coat resin layer.

The average particle diameter of the filler is appropriately selected depending on the intended purpose without any limitation, but it is preferably 0.1 μm to 0.5 μm in the number average particle diameter for achieving the numerical range of the flow energy amount of the developer.

The number average particle diameter of the filler can be measured by means of a laser diffraction/scattering particle size analyzer (for example, product name: LA-950V2, manufactured by Horiba, Ltd.).

The filler is preferably incorporated, for example, by adding the filler to a solve used for coating, or a resin solution used for forming a carrier coat resin layer, and homogenously dispersed the resultant by means of a disperser using media, such as a ball mill and a bead mill, or a disperser equipped with a high-speed rotatable wing, to thereby form a dispersion liquid.

Moreover, the carrier coat layer may contain various dispersants for improving dispersibility of the filler, and may contain a silane coupling agent for adjusting a charging amount of the toner.

The silane coupling agent is appropriately selected depending on the intended purpose without any limitation, but it is particularly preferred that the following aminosilane coupling agent be appropriately added to a silicone resin for the purpose of adjusting the electric charged amount of the resulting toner.

$H_2N(CH_2)_3Si(OCH_3)_3$ (weight average molecular weight: 179.3)

$H_2N(CH_2)_3Si(OC_2H_5)_3$ (weight average molecular weight: 221.4)

$H_2NCH_2CH_2CH_2Si(CH_3)_2(OC_2H_5)$ (weight average molecular weight: 161.3)

$H_2NCH_2CH_2CH_2Si(CH_3)(OC_2H_5)_2$ (weight average molecular weight: 191.3)

$H_2NCH_2CH_2NHCH_2Si(OCH_3)_3$ (weight average molecular weight: 194.3)

$H_2NCH_2CH_2NHCH_2CH_2CH_2Si(CH_3)(OCH_3)_2$ (weight average molecular weight: 206.4)

$H_2NCH_2CH_2NHCH_2CH_2CH_2Si(OCH_3)_3$ (weight average molecular weight: 224.4)

$(CH_3)_2NCH_2CH_2CH_2Si(CH_3)(OC_2H_5)_2$ (weight average molecular weight: 219.4)

$(C_4H_9)_2NC_3H_6Si(OCH_3)_3$ (weight average molecular weight: 291.6)

An amount of the amino silane coupling agent is appropriately selected depending on the intended purpose without any limitation, but it is preferably 0.001% by mass to 30% by mass.

A thickness of the carrier coat resin layer is appropriately selected depending on the intended purpose without any limitation, but it is preferably 0.05 μm to 4 μm in the average film thickness. When the average film thickness thereof is less than 0.05 μm, the resulting carrier coat resin layer may be easily peeled off. When the average film thickness thereof is greater than 4 μm, the carrier coat resin layer is not magnetic material, and therefore the carrier tends to be deposited on an image.

The average film thickness of the carrier coat resin layer can be measured by observing a cross-section of the carrier under a transmission electron microscope (TEM).

The volume resistivity value of the carrier is appropriately selected depending on the intended purpose without any limitation, but it is preferably $1\times10^9$ Ω·cm to $1\times10^{17}$ Ω·m. When the volume resistivity value is lower than $1\times10^9$ Ω·cm, carrier deposition may occur in a non-image part. When the volume resistivity value is greater than $1\times10^{17}$ Ω·cm, the edge effect is enhanced up to the level that exceeds the acceptable level.

By appropriately controlling the volume resistivity value of the carrier, a highly precise image having excellent reproducibility of fine lines, such as characters, without color smears and excessive edge effect, can be attained. The volume resistivity value of the carrier can be controlled by controlling the resistivity of the carrier coat resin layer formed on the core, adding the filler, or adjusting a film thickness of the carrier coat resin layer.

The volume resistivity value can be measured, for example, by a blow-off device (TB-200, manufactured by KYOCERA Chemical Corporation [previously Toshiba Chemical Corporation]).

The magnetization of the carrier is appropriately selected depending on the intended purpose without any limitation, but it is preferably 40 $Am^2/kg$ to 90 $Am^2/kg$ in the magnetic field of 1 kOe ($10^6/4\pi$ [A/m]). When the magnetization thereof is lower than 40 $Am^2/kg$, the carrier may be deposited on an image. When the magnetization thereof is higher than 90 $Am^2/kg$, the formed magnetic brush becomes stiff, which may cause formation of missing parts in an image because of slight toughing of the magnetic brush.

A method for covering the core with the carrier coat resin layer is appropriately selected from methods known in the art depending on the intended purpose without any limitation, and examples thereof include spray drying, dipping, and powder coating.

Moreover, it is preferred that a heat treatment be performed after covering the core with the carrier coat resin layer, because a crosslink reaction is accelerated by condensation.

The temperature of the heat treatment is appropriately selected depending on the intended purpose without any limitation, but it is preferably the temperature lower than Curie point of the core for use, more preferably 100° C. to 350° C., and even more preferably 150° C. to 250° C. When the temperature is lower than 100° C., the crosslink reaction is not progressed by condensation, which may not be able to provide a carrier coat resin layer of sufficient strength. When the temperature thereof is higher than 350° C., the carrier coat resin may start carbonizing, and as a result, the carrier coat resin layer may be easily scraped.

—Toner—

The toner is appropriately selected from toners known in the art depending on the intended purpose without any limitation, but it is preferably a toner containing a binder resin mainly formed of a thermoplastic resin, and a colorant contained in the binder resin. The toner is particularly preferably a toner containing particles, a charge controlling agent, and a releasing agent.

The shapes of the toner particles are appropriately selected depending on the intended purpose without any limitation, and they may be irregular shapes, or spherical shapes. In addition, the toner may be a magnetic toner or non-magnetic toner.

—Binder Resin—

The binder resin is appropriately selected depending on the intended purpose without any limitation, and examples thereof include: a styrene-based binder resin, such as styrene and a substituted styrene homopolymer (e.g., polystyrene, and polyvinyl toluene), and a styrene copolymer (e.g., styrene-p-chlorostyrene copolymer, styrene-propylene copolymer, styrene-vinyl toluene copolymer, styrene-methyl acrylate copolymer, styrene-ethyl acrylate copolymer, styrene-butyl acrylate copolymer, styrene-methyl methacrylate copolymer, styrene-ethyl methacrylate copolymer, styrene-butyl methacrylate copolymer, styrene-α-chloromethyl methacrylate copolymer, styrene-acrylonitrile copolymer, styrene-vinylmethyl ether copolymer, styrene-vinylmethyl ketone copolymer, styrene-butadiene copolymer, styrene-isoprene copolymer, styrene-maleic acid copolymer, and styrene-maleic ester copolymer); an acrylic binder such as polymethyl methacrylate, and polybutyl methacrylate; and others such as polyvinyl chloride, polyvinyl acetate, polyethylene, polypropylene, polyester, polyurethane, an epoxy resin, polyvinyl butyral, a polyacrylic resin, rosin, modified rosin, a trephine resin, a phenol resin, an aliphatic or aliphatic hydrocarbon resin, an aromatic petroleum resin, chlorinated paraffin, and paraffin wax. These may be used independently, or in combination.

Among them, the binder resin is preferably a polyester resin, because the resulting toner can reduce its melt viscosity while securing storage stability thereof. Moreover, the polyester resin is preferable because it can reduce the melt viscosity of the resulting toner more than a styrene or acrylic resin, while securing the storage stability thereof.

The polyester resin is appropriately selected depending on the intended purpose without any limitation, and for example, it can be obtained through a polycondensation reaction between an alcohol component and a carboxylic acid component.

The alcohol component is appropriately selected depending on the intended purpose without any limitation, and examples thereof include: diols such as polyethylene glycol, diethylene glycol, triethylene glycol, 1,2-propylene glycol, 1,3-propylene glycol, 1,4-propylene glycol, neopentyl glycol, and 1,4-butanediol; 1,4-bis(hydroxymethyl)cyclohexane; etherified bisphenols such as bisphenol A, hydrogenated bisphenol A, polyoxyethylated bisphenol A, and polyoxypropylated bisphenol A; dihydric alcohol monomers substituted with a $C_3$-$C_{22}$ saturated or unsaturated hydrocarbon group; other dihydric alcohol monomers; and trihydric or higher alcohol monomers such as sorbitol, 1,2,3,6-hexanetetrol, 1,4-sorbitan, pentaerythritol, dipentaerythritol, tripentaerythritol, sucrose, 1,2,4-butanetriol, 1,2,5-pentanetriol, glycerol, 2-methylpropanethiol, 2-methyl-1,2,4-butanetriol, trimethylol ethane, trimethylol propane, and 1,3,5-trihydroxymethyl benzene. These may be used independently, or in combination.

The carboxylic acid component is appropriately selected depending on the intended purpose without any limitation, and examples thereof include: monocarboxylic acid, such as palmitic acid, stearic acid, and oleic acid; dicarboxylic acid, such as maleic acid, fumaric acid, mesaconic acid, citraconic acid, terephthalic acid, cyclohexane dicarboxylic acid, succinic acid, adipic acid, sebacic acid, malonic acid, divalent organic acid monomer, divalent organic monomer in which any of the foregoing acids is substituted with a C3-C22 saturated or unsaturated hydrocarbon group, anhydride of the foregoing acids, lower alkyl ester thereof, and dimmer acid thereof with linoleic acid; and tri or higher polycarboxylic acid monomer, such as 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxyl-2-methyl-2-methylene carboxylpropane, tetra(methylene carboxyl)methane, 1,2,7,8-octane tetracarboxylic acid, Empol trimer acid, and anhydrides of the foregoing acids. These may be used independently, or in combination.

The epoxy resin is appropriately selected depending on the intended purpose without any limitation, and examples thereof include polycondensate of bisphenol A and epichlorohydrin.

As for the epoxy resin, a commercial product thereof can be used. Specific examples of the commercial product thereof include: EPOMIK R362, EPOMIK R364, EPOMIK R365, EPOMIK R366, EPOMIK R367, and EPOMIK R369 (product names, all manufactured by Mitsui Chemicals, Inc.); EPOTOTO YD-011, EPOTOTO YD-012, EPOTOTO YD-014, EPOTOTOYD-904, and EPOTOTOYD-017 (product names, all manufactured by Tohto Kasei Company Ltd.); and EPIKOTE 1002, EPIKOTE 1004, and EPIKOTE 1007 (product names, all available from Shell).

—Colorant—

The colorant is appropriately selected depending on the intended purpose without any limitation, and all conventional dyes and/or pigments can be used as the colorant.

Examples of the colorant include dyes and pigments, such as carbon black, lamp black, iron black, ultramarine blue, a nigrosin dye, aniline blue, phthalocyanine blue, Hansa yellow G, rhodamine 6G lake, calco oil blue, chrome yellow, quinacridone, benzidine yellow, rose bengal, triarllylmethane dye, a monoazo dye, and a diazo dye. These may be used independently, or in combination.

It is possible to add a magnetic material to a black toner to thereby make it a magnetic toner. The magnetic material is appropriately selected depending on the intended purpose without any limitation, and examples thereof include powders of hard magnetic material (e.g., iron and cobalt), magnetite, hematite, Li-based ferrite, Mn—Zn-based ferrite, Cu—Zn-based ferrite, Ni—Zn ferrite, and Ba ferrite.

—Charge Controlling Agent—

The charge controlling agent is appropriately selected from charge controlling agents known in the art without any limitation, and examples thereof include: a metal complex salt of a monoazo dye; nitrofumic acid and/or a salt thereof; salicylic acid; a naphthoic acid salt; an amino compound of a metal complex (e.g. of Co, Cr, Fe) of dicarboxylic acid; a quaternary ammonium compound; and an organic dye. These may be used independently, or in combination.

Note that, the charge controlling agent for use in a color toner other than a black toner is preferably a white metal salt of salicylic acid derivative.

The addition of the charge controlling agent to the toner is preferable because the frictional electrification properties of the toner can be sufficiently controlled.

—Releasing Agent—

The releasing agent is appropriately selected from conventional releasing agents known in the art without any limitation, and examples thereof include low molecular weight polypropylene, low molecular weight polyethylene, carnauba wax, microcrystalline wax, jojoba wax, rice wax, and motanic acid wax. These may be used independently, or in combination.

—Other Components—

Other components are appropriately selected depending on the intended purpose without any limitation, and examples thereof include additives such as a flow improving agent.

In order to attain an excellent image, it is important to provide sufficient flowability to the toner. To this end, it is effective to externally add particles of metal oxide, which has been generally processed to have hydrophobicity, as a flow improving agent, or particles of a lubricant. As for the additive, metal oxide, organic resin particles, and metal soap can be used.

Specific examples of the additive include: a fluororesin such as polytetrafluoroethylene; a lubricant such as zinc stearate; abrasives such as cerium oxide, and silicon carbide; a flow improving agent such as inorganic oxides (e.g., $SiO_2$, and $TiO_2$) whose surfaces have been processed to have hydrophobicity; those known as a caking inhibitor; and surface-treated products of the foregoing materials. These may be used independently, or in combination.

Among them, hydrophobic silica is particularly preferable for improving flowability of the toner.

The weight average particle diameter of the toner particles is appropriately selected depending on the intended purpose without any limitation, but it is preferably 3.0 μm to 9.0 μm, more preferably 3.0 μm to 6.0 μm.

The weight average particle diameter of the toner particles can be measured, for example, by Coulter Multisizer II (manufactured by Beckman Coulter, Inc.).

A production method of the toner is appropriately selected depending on the intended purpose without any limitation, and examples thereof include: polymerization methods such as suspension polymerization, emulsification polymerization-dispersion polymerization, emulsification aggregation, and emulsification association; polymer dissolution suspension, atomizing, and pulverizing.

<Transferring Step, Transferring Unit>

The transferring step is transferring the visible image formed in the developing step to a recording medium, and is suitably carried out by the transferring unit.

The transferring step is transferring the visible image to a recording medium, but is preferably an embodiment where an intermediate transfer member is used, and the visible image is primary transferred onto the intermediate transfer member, and is then secondary transferred to the recording medium.

As for the transferring unit, a preferable embodiment thereof includes a primary transferring unit configured to transfer the visible image onto an intermediate transfer member to form a composite transfer image, and a secondary transferring unit configured to transfer the composite transfer image onto a recording medium.

In the case where the image secondary transferred to the recording medium is a color image formed of a plurality of colors of the toners, the toner of each color is successively superimposed on the intermediate transfer member by the transferring unit to form an image on the intermediate transfer member, and the image formed on the intermediate transfer member is transferred to a recording medium at once by the intermediate transferring unit.

The intermediate transfer member is appropriately selected from transfer members known in the art without any limitation, and examples thereof include a transfer belt.

The transferring unit (the primary transferring unit, the secondary transferring unit) preferably contains at least a transfer device configured to charge the visible image formed on the latent electrostatic image bearing member (e.g. the photoconductor) to release the visible image from the photoconductor to the side of the recording medium. The number of the transferring units equipped may be 1, or 2 or more. Examples of the transfer unit include a corona transfer unit utilizing corona discharge, a transfer belt, a transfer roller, a pressure transfer roller, and an adhesion transfer member.

The recording medium is typically plain paper, but it is appropriately selected depending on the intended purpose without any restriction, provided that an unfixed image after the developing can be transferred thereto. Examples thereof include a PET base for OHP.

<Fixing Step, Fixing Unit>

The fixing step is fixing the transfer image transferred onto the recording medium in the transferring step with a fixing member, and is suitably carried out by the fixing unit.

The fixing unit is appropriately selected depending on the intended purpose without any limitation, but it is preferably a heating and pressurizing member known in the art. Examples of the heating and pressurizing member include a combination of a heating roller and a pressurizing roller, and a combination of a heating roller, a pressurizing roller, and an endless belt.

The heating by the heating and pressurizing member is generally performed preferably at 80° C. to 200° C.

In the present invention, together with or in place of the fixing unit, for example, a conventional optical fixing unit may be used depending on the intended purpose.

<Diselectrification Step and Diselectrification Unit>

The diselectrification step is applying diselectrification bias to the latent electrostatic image bearing member to thereby diselectrify the latent electrostatic image bearing member, and is suitably carried out by the diselectrification unit.

The diselectrification unit is appropriately selected from conventional diselectrification units known in the art without any limitation, provided that it is capable of applying diselectrification bias to the photoconductor. The diselectrification unit is, for example, preferably a diselectrification lamp.

<Cleaning Step and Cleaning Unit>

The cleaning step is removing the residual toner on the photoconductor, and the cleaning step can be suitably carried out by a cleaning unit. Note that, it is also possible to use a method where the residual toner is charged to have the same polarity by a friction member and then collected by a developing roller, without using the cleaning unit.

The cleaning unit is appropriately selected from cleaners known in the art without any limitation, provided that it is capable of removing the toner remained on the photoconductor. Preferable examples thereof include a magnetic brush cleaner, an electrostatic brush cleaner, a magnetic roller cleaner, a blade cleaner, a brush cleaner, and a web cleaner.

<Recycling Step and Recycling Unit>

The recycling step is recycling the toner removed in the cleaning step to the developing unit, and the recycling can be suitably carried out by a recycling unit. The recycling unit is not particularly restricted, and examples thereof include conventional conveying units.

<Controlling Step and Controlling Unit>

The controlling step is controlling operations of each step, and can be suitably carried out by a controlling unit.

The controlling unit is appropriately selected depending on the intended purpose without any limitation, provided that it is capable of controlling the operations of each step. Examples thereof include devices such as a sequencer, and a computer.

The image forming apparatus is preferably an image forming apparatus containing a process cartridge in which the latent electrostatic image bearing member and at least the developing unit are integratedly supported, where the process cartridge is detachably mounted to the image forming apparatus.

The image forming apparatus of the present invention will be specifically explained with reference to drawings hereinafter, but the image forming apparatus of the present invention shall not be construed as to limit to the following examples accompanied with the drawings.

FIG. 1 is a schematic cross-sectional view illustrating one example of the image forming apparatus of the present invention.

Image forming units 6Y, 6M, 6C, 6Bk corresponding to a respective color (yellow, magenta, cyan, and black) are parallel aligned facing the bottom surface of an intermediate transfer belt 8 serving as a non-fixed image bearing member in an intermediate transfer unit 10. The image forming units 6Y, 6M, 6C, 6Bk each contain a photoconductor drum 1Y, 1M, 1C, or 1Bk, and developing unit 5Y, 5M, 5C, or 5Bk of the respective color.

These image forming units 6Y, 6M, 6C, and 6Bk, the photoconductor drums 1Y, 1M, 1C, and 1Bk, and the developing units 5Y, 5M, 5C, and 5Bk each have the same configurations, provided that a color of the toner used in the image forming process is different. The image forming units 6Y, 6M, 6C, and 6Bk may be collectively referred to as an "image forming unit 6" hereinafter. Moreover, the photoconductor drums 1Y, 1M, 1C, and 1Bk may be collectively referred to as a "photoconductor drum 1." Further, the developing units 5Y, 5M, 5C, and 5Bk may be collectively referred to as a "developing unit 5."

The image forming unit 6 is constituted of a photoconductor drum 1 serving as a latent image bearing member, a charging unit (not illustrated) provided adjacent to the photoconductor drum 1, a developing unit 5, a cleaning unit (not illustrated), and the like.

An image forming process (including, for example, the aforementioned charging step, latent electrostatic image forming step, developing step, transferring step, cleaning step, and diselectrification step) is performed on the photoconductor drum 1 to thereby a predetermined toner image on the photoconductor drum 1. Specifically, the photoconductor drum 1 is driven by a driving unit (not illustrated) to rotate in the clockwise direction in the drawing, and a surface thereof is uniformly charged at the position of the charging unit (the charging step).

Thereafter, the surface of the photoconductor drum 1 reaches an irradiation position of laser light emitted from an exposure unit (not illustrated), and at this position a latent electrostatic image is formed by exposure scanning (latent electrostatic image forming step).

Thereafter, the surface of the photoconductor drum 1 reaches the position facing the developing unit 5, and the latent electrostatic image thereon is developed at this position to thereby form a predetermined toner image (the developing step).

Then, the surface of the photoconductor drum 1 reaches the position facing the intermediate transfer belt 8, and primary transfer bias rollers 9Y, 9M, 9C, and 9Bk, and the toner image on the photoconductor drum 1 is transferred onto the intermediate transfer belt 8 at this position (the primary transferring step).

Thereafter, the surface of the photoconductor 1 reaches the position facing the cleaning unit, and the untransferred toner remained on the photoconductor drum 1 is collected at this position (the cleaning step).

After the cleaning, the charge potential of the surface of the photoconductor drum 1 is initialized by a diselectrification roller (not illustrated) (the diselectrification step). In the manner as described above, a series of the image forming process performed on the photoconductor drum 1 is completed.

The aforementioned image forming process is performed in each of four image forming units 6Y, 6M, 6C, and 6Bk, as illustrated in FIG. 1. Specifically, laser light based on the image information is emitted from the exposure unit (not illustrated), which is disposed at the bottom side of the image forming unit 6, to a photoconductor drum in each image forming unit 6Y, 6M, 6C, or 6Bk. Thereafter, a toner image of each color is formed on each photoconductor through the developing step, and the formed toner images are superimposed and transferred onto the intermediate transfer belt 8. In this manner, a color image is formed on the intermediate transfer belt 8.

The four primary transfer bias rollers 9Y, 9M, 9C, and 9Bk each forms a primary transfer nip with the photoconductor drums 1Y, 1M, 1C, 1Bk with the intermediate transfer belt 8 being nipped therebetween. Transfer bias having a reverse polarity to that of the toner is applied to the primary transfer bias rollers 9Y, 9M, 9C, and 9Bk. The intermediate transfer belt 8 travels in the direction shown with the arrow, to sequentially pass through the primary transfer nips of the primary transfer bias rollers 9Y, 9M, 9C, and 9Bk. In this manner, the toner images on the respective photoconductor drum 1Y, 1M, 1C, and 1Bk are superimposed and primary transferred onto the intermediate transfer belt 8.

Thereafter, the intermediate transfer belt 8 onto which the toner images of all the colors have been superimposed and transferred reaches a position facing a secondary transfer roller 19 serving as a secondary transferring unit. The color toner image formed on the intermediate transfer belt 8 is transferred onto transfer paper P serving as a recording medium, and transported to the position of the secondary transfer nip. In this manner, a series of the transfer process performed on the intermediate transfer belt 8 is completed.

The paper feeding unit 26 provided at the bottom side of the device main body 100 houses therein stack of sheets of the transfer paper P, and the transfer paper P is separated one by one by the paper feeding roller 27 to be fed. The fed transfer paper P is temporarily stopped by a pair of the registration rollers 28, and feeding angle thereof is corrected, followed by transported to the secondary transfer nip by means of the pair of the registration rollers 28 with the predetermined timing. As described above, the predetermined color image is transferred onto the transfer paper P at the secondary transfer nip.

The transfer paper P, to which the color image has been transferred at the position of the secondary transfer nip, is transported to a fixing unit 20, and the color image transferred onto a surface of the transfer paper P is fixed on the surface thereof by heat and pressure applied by a fixing roller and a pressure roller. The transfer paper P which have been completed the fixing is then discharged by a pair of discharging rollers 29 as an output image to a discharging unit 30 formed on the top surface of the device main body. In this manner, a series of the image forming process performed by the image forming apparatus is completed. In FIG. 1, the numeral reference 32 denotes a reading unit.

Figure 2:
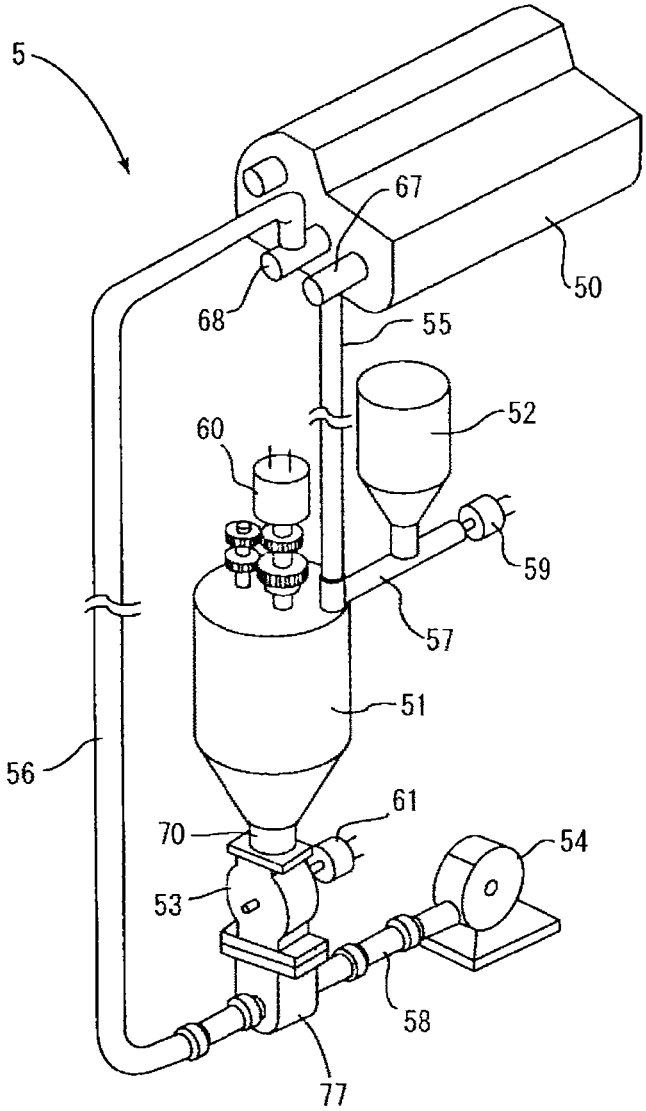
FIG. 2 is a perspective view illustrating a developing unit in one embodiment of the image forming apparatus of the present invention.

The two-component developer preparing process and transporting process will be specifically explained next. FIG. 2 is a perspective view illustrating one example of a developing unit of the image forming apparatus of the present invention.

As illustrated in FIG. 2, the developing unit 5 contains a developing element 50 configured to develop a latent electrostatic image on a photoconductor drum 1, a stirring unit 51 configured to stir the developer according to the condition of the developer from the position apart from the developing element 50, a toner cartridge 52 configured to supply a toner to the stirring unit 51, a rotary feeder 53 provided at the bottom of the stirring unit 51, and an air pump 54, serving as a developer circulation driving source, configured to transport the developer by air pressure. Note that, the developing unit 5 in FIG. 1 only depicts the developing element 50.

The developing element 50 and the stirring unit 51 are connected with a circulation path 55, and the rotary feeder 53 and the developing element 50 are connected with a circulation path 56. The toner cartridge 52 and the stirring unit 51 are connected with a toner supply path 57, and the air pump 54 and the rotary feeder 53 are connected with a pipe line 58. In FIG. 2, the numeral reference 59 denotes a motor serving as a toner supply driving source, the numeral reference 60 denotes a motor serving as a stirring driving source, and the numeral reference 61 denotes a motor serving as a driving source for the rotary feeder 53.

Figure 5:
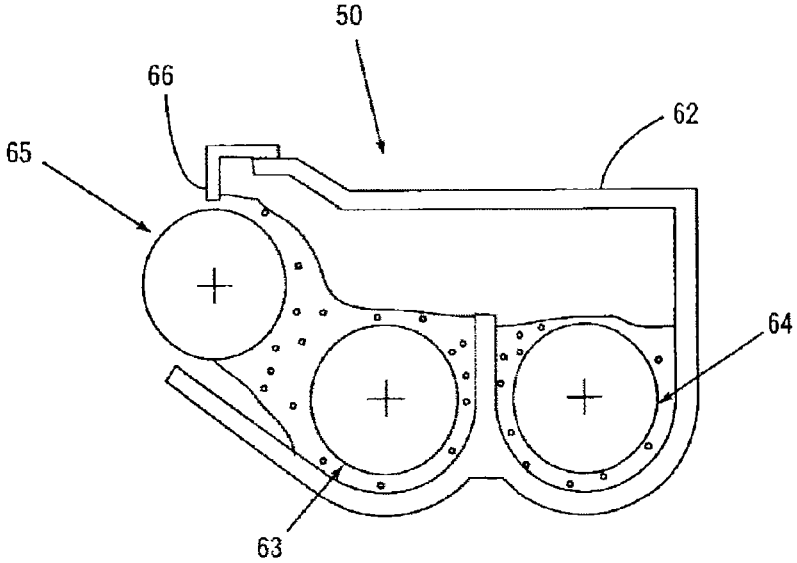
FIG. 5 is a schematic cross-sectional view of a developing unit in one embodiment of the image forming apparatus of the present invention.

FIG. 5 is a cross-sectional view of the developing element in the image forming apparatus of the present invention. As illustrated in FIG. 5, the developing element 50 contains a casing 62 for constituting the developing element, transport screws 63, 64 each rotatably supported in the casing 62 and having a spiral fin, and a developing roller 65. In the casing 62, the two-component developer transported from the stirring unit is housed. The developer is circulated and transported in the casing 62 by the transport screws 63, 64. The developer is transported by the transport screw 63 from the front side to the back side with respect to the cross-section in the figure, and part of the developer is scooped with and absorbed on with the developer roller 65 by the magnetic force. The developer on the developer roller 65 is leveled by a doctor blade 66 to have a uniform thickness, followed by bringing in contact with a photoconductor drum 1 to develop a latent electrostatic image on the photoconductor drum 1 with the toner, to thereby form a toner image.

The developer after being used for developing is transported from the outlet 67 (see FIG. 2), which is provided at the edge part of the transport screw 64, to the stirring unit 51 through the circulation path 55. A toner density detection unit (not illustrated) is provided at the very bottom of the transport screw 64, and the toner is supplied from the toner cartridge 52 based on the signal from the toner density detection unit.

Supplying the toner is performed by rotating a screw (not illustrated) in the toner supply path 57 by a motor 59. The supplying the toner is performed in the section where it is in the circulation path and just before the inlet of the stirring unit 51.

In the stirring unit 51, the developer after the developing and the supplied toner are mixed to thereby provide a developer having an appropriate toner density and charged amount. The resulting developer is passed through the outlet 70 formed at the bottom of the stirring unit 51, to thereby enter the rotary feeder 53. By the rotation of the rotor 75 (see FIG. 3A) in the rotary feeder 53, the developer is discharged in a constant amount to the bottom side, passed through the circulation path 56, and again supplied to the developing element 50 through the inlet 68.

Figure 3A:
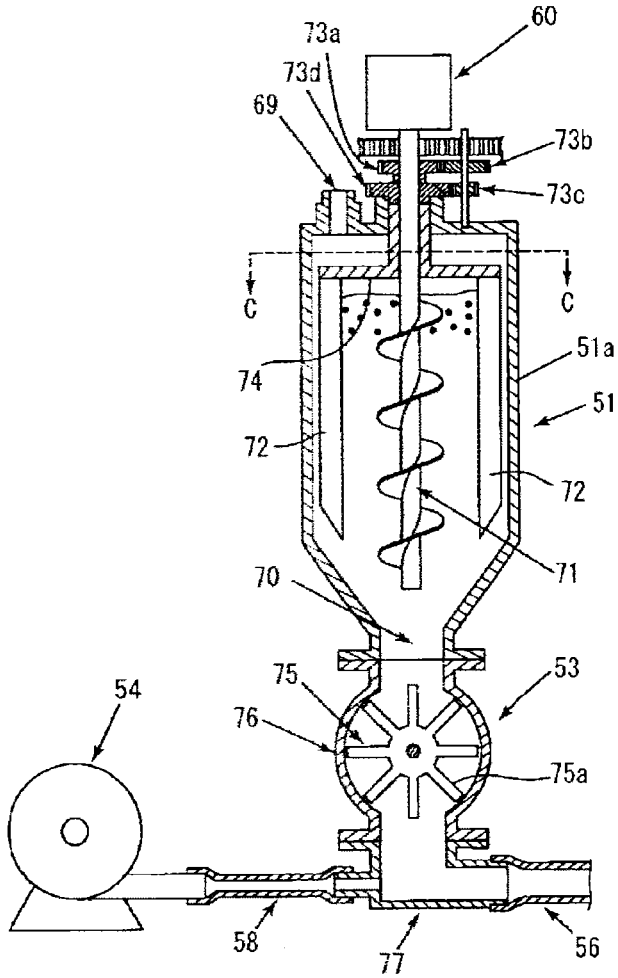
FIG. 3A is a vertical section view illustrating a stirring unit in one embodiment of the image forming apparatus of the present invention.
Figure 3B:
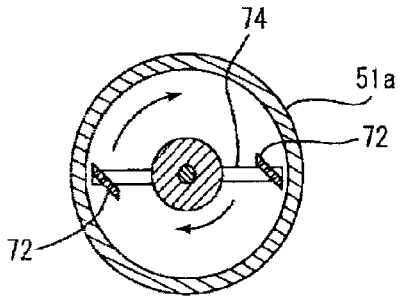
FIG. 3B is a horizontal section view of the line C-C in FIG. 3A.

FIG. 3A is vertical cross-sectional (direction parallel to the rotational axis) view illustrating one example of the stirring unit in the image forming apparatus of the present invention, and FIG. 3B is a horizontal section view cut with the line C-C in FIG. 3A. On the top plane of the stirring unit 51, a supply inlet 69 is provided. A discharge outlet 70 is provided on the bottom plane thereof. The stirring unit main body 51*a* has a reverse conical shape, whose diameter decreases towards the discharge outlet 70.

In the stirring unit main body 51*a*, a transport screw 71 configured to transport the developer from the bottom to the top is provided at a center thereof, and two rotatable stirring members 72 is provided outside the transport screw 71. By the rotational movements of these stirring unit members, the developer is stirred and mixed. The stirring members 72 provided the outer side, and the transport screw 71 are rotated by a motor 60. The transport screw 71 is directly connected to the motor 60, and the outer stirring members 72 are rotated via the sequence of reducing gears 73*a* to 73*d*.

The stirring member 72 is, as illustrated in FIG. 3A, is fixed diagonally to the supporting unit 74 that is directly connected to the sequence of the reducing gears. The transportation of the developer from the supply inlet 69 of the stirring unit 51 to the discharge outlet 70 is performed by utilizing gravity.

Since the developer is always present in the stirring unit 51 as a buffer, there is no case where a non-mixed developer is not discharged as it is.

The rotary feeder 53 is rotated by a motor 61, and has a rotor 75 having a plurality of wings 75*a* each extended radially, and a stator 76 covering the rotor 75. The rotary feeder 53, the circulation path 56, and the pipe line 58 are connected with a coupling pipe line 77.

Figure 4:
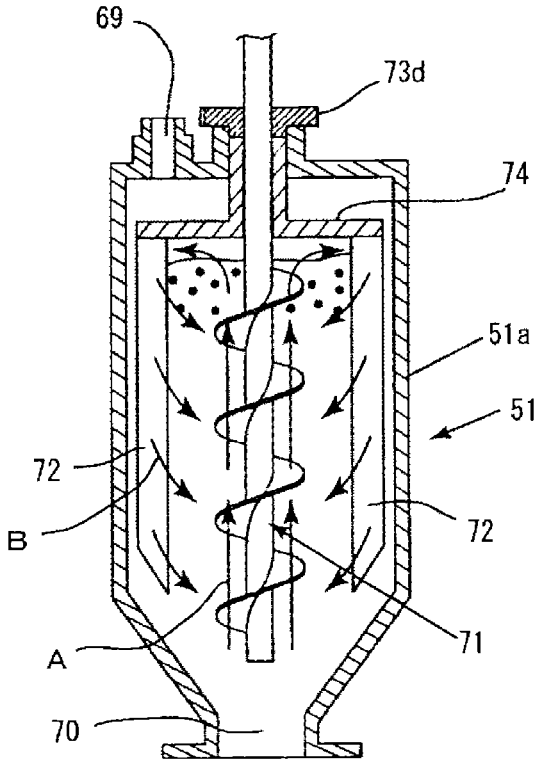
FIG. 4 is a cross-sectional view explaining a flow of a developer during stirring in a stirring unit in one embodiment of the image forming apparatus of the present invention.

FIG. 4 is a cross-sectional view illustrating a flow of the developer during the stirring in the stirring unit 51. The developer lifted from the bottom to the top in the direction shown with the arrow A by the rotation of the transport screw 71 is transported to the direction shown with the arrow B along the rotation of the stirring member 72 rotated outside, and again collected around the transport screw 71. In the manner as mentioned, the developer is continuously circulated in the stirring unit 51. It is designed to uniformly mix the developer in the entire container (in the stirring unit main body 51*a*) by the aforementioned circulation.

The charge of the toner is provided by frictions between the toner and the carrier, and therefore it is important for quickly attain the desired charging amount to increase the contact probability of the toner with the carrier. As a result of the studies conducted by the present invention, it has been found that the contact probability is increased by circulating the developer in the stirring unit 51, and the damage to the developer is kept minimum.

<Application>

Since the image forming method and image forming apparatus can prepare a developer of a constant density, in which a toner and a carrier are uniformly mixed, effectively provide an appropriate charge amount without providing stress to the developer, and continuously, stably and effectively transport a constant amount of the developer to a developing element, the image forming method and image forming apparatus of the present invention can be used in various fields, and can be suitably used especially in electrophotographic image formation, such as by a printer and a photocopier.

EXAMPLES

The present invention will be specifically explained through examples of the present invention hereinafter, but these examples shall not be construed as to limit the scope of the present invention. In the following examples and comparative examples, "part(s)" denotes "part(s) by mass" and "%" denotes "% by mass," unless otherwise stated.

Production Example A-1

Production of Carrier Core 1

$MnCO_3$, $Mg(OH)_2$, and $Fe_2O_3$ powder were each weighted and mixed together to have the component ratio depicted in Table 1 below, to thereby obtain mixed powder. The mixed powder was calcinated in a heating furnace at 900° C. for 3 hours in the ambient atmosphere, and the resulting calcinated product is cooled to room temperature (about 25° C.), followed by pulverized by a cracking machine, to thereby yield powder having the weight average particle diameter of 7 μm (first step).

The resulting powder, a dispersant in an amount of 1% relative to the mass of the powder, and water were added together to thereby form into a slurry, and the resulting slurry was provided to a spray dryer for granulation, to thereby yield a granulated product having the weight average particle diameter of about 40 μm (second step).

The resulting granulated product was placed in a baking furnace, and was baked in a nitrogen atmosphere at 1,250° C. for 5 hours. The resulting baked product was cooled to room temperature (about 25° C.), followed by cracked by a cracking machine. The resultant was subjected to screen classification to thereby adjust the particle size (third step). As a result, Carrier Core 1 consisting of spherical ferrite particles having the weight average particle diameter of about 35 μm was obtained.

SF-2 of Carrier Core 1 was measured in the following method. The result is presented in Table 1.

<Measurement of SF-2>

The shape factor SF-2 was measured in the following manner. The enlarged particle images (magnification: ×300) were obtained by a field emission scanning electron microscope (FE-SEM) (S-800, manufactured by Hitachi, Ltd.), and the images of 100 particles were randomly selected from the enlarged particle images. The image information was introduced to an image analyzer (e.g., Luzex AP, NIRECO CORPORATION) via an interface to binarize the image data. The resulting analysis result was used, and the value obtained by calculating by the following formula (2) was determined as the value of shape factor SF-2. Note that, the value of the shape factor SF-2 closer to 100 means the shape of the particle is closer to a complete round (sphere).

$$SF\text{-}2=(P^2/A)\times(1/4\pi)\times 100 \qquad \text{Formula (2)}$$

In the formula (2), P is a boundary length of the shape obtained by projecting the core on the two dimensional plane, and A is a projected area of the core.

Production Example A-2

Production of Carrier Core 2

Carrier Core 2 consisting of spherical ferrite particles having the weight average particle diameter of about 35 μm was obtained in the same manner as in Production Example A-1, provided that the pulverizing to give the weight average particle diameter of about 7 μm in the first step was changed to pulverizing to give the weight average particle diameter of about 1 μm.

SF-2 of the resulting carrier core was measured in the same manner as in Production Example A-1. The result is presented in Table 1.

Production Example A-3

Production of Carrier Core 3

$MnCO_3$, $Mg(OH)_2$, $Fe_2O_3$, and $SrCO_3$ powder were each weighted and mixed together to have the component ratio depicted in Table 1 below, to thereby obtain mixed powder. The mixed powder was calcinated in a heating furnace at 850° C. for 1 hour in the ambient atmosphere, and the resulting calcinated product is cooled to room temperature (about 25° C.), followed by pulverized by a cracking machine, to thereby yield powder having the weight average particle diameter of about 3 μm or smaller (first step).

The resulting powder, a dispersant in an amount of 1% relative to the mass of the powder, and water were added together to thereby form into a slurry, and the resulting slurry was provided to a spray dryer for granulation, to thereby yield a granulated product having the weight average particle diameter of about 40 μm (second step).

The resulting granulated product was placed in a baking furnace, and was baked in a nitrogen atmosphere at 1,120° C.

for 4 hours. The resulting baked product was cooled to room temperature (about 25° C.), followed by cracked by a cracking machine. The resultant was subjected to screen classification to thereby adjust the particle size (third step). As a result, Carrier Core 3 consisting of spherical ferrite particles having the weight average particle diameter of about 35 μm was obtained.

SF-2 of the resulting carrier core was measured in the same manner as in Production Example A-1. The result is presented in Table 1.

Production Example A-4

Production of Carrier Core 4

Carrier Core 4 consisting of spherical ferrite particles having the weight average particle diameter of about 35 μm was obtained in the same manner as in Production Example A-3, provided that the baking temperature of the granulated product in the third step was changed from 1,120° C. to 1,180° C.

SF-2 of the resulting carrier core was measured in the same manner as in Production Example A-1. The result is presented in Table 1.

Production Example A-5

Production of Carrier Core 5

Carrier Core 5 consisting of spherical ferrite particles having the weight average particle diameter of about 35 nm was obtained in the same manner as in Production Example A-3, provided that the baking temperature of the granulated product in the third step was changed from 1,120° C. to 1,080° C. SF-2 of the resulting carrier core was measured in the same manner as in Production Example A-1. The result is presented in Table 1.

TABLE 1

| | Component ratio (mol %) | | | | SF-2 of |
|---|---|---|---|---|---|
| | MnO | MgO | $Fe_2O_3$ | SrO | carrier core |
| Carrier Core 1 | 46.2 | 0.7 | 53.0 | — | 145 |
| Carrier Core 2 | 46.2 | 0.7 | 53.0 | — | 128 |
| Carrier Core 3 | 40.0 | 10.0 | 50.0 | 0.4 | 155 |
| Carrier Core 4 | 40.0 | 10.0 | 50.0 | 0.4 | 132 |
| Carrier Core 5 | 40.0 | 10.0 | 50.0 | 0.4 | 165 |

Production Example B-1

Production of Carrier Coat Resin 1

A flask equipped with a stirrer was charged with 300 g of toluene, and was heated to 90° C. under ventilating current of nitrogen. To this, a mixture containing 84.4 g of 3-methacryloxypropyltris(trimethylsiloxy)silane (200 mmol Silaplane TM-0701T, manufactured by CHISSO CORPORATION) represented by $CH_2$=CMe-COO—$C_3H_6$—Si(OSiMe$_3$)$_3$ (where Me is a methyl group), 39 g (150 mmol) of 3-methacryloxypropylmethyldiethoxysilane, 65.0 g (650 mmol) of methyl methacrylate, and 0.58 g (3 mmol) of 2,2'-azobis-2-methylbutyronitrile was added dropwise over the period of 1 hour.

After the dripping, a solution prepared by dissolving 0.06 g (0.3 mmol) of 2,2'-azobis-2-methylbutyronitrile in 15 g of toluene was further added thereto (a total amount of 2,2'-azobis-2-methylbutyronitrile: 0.64 g [3.3 mmol]), followed by mixing for 3 hours at 90° C. to 100° C. to preceed to a radical copolymerization, to thereby yield a methacryl-based copolymer represented by the following general formula (1). The obtained copolymer was used as Carrier Coat Resin 1.

The weight average molecular weight of Carrier Coat Resin 1 was 33,000. Next, Carrier Coat Resin 1 was diluted with toluene to thereby yield a solution of Carrier Coat Resin 1 having a non-volatile component content of 25%. The viscosity of Carrier Coat Resin 1 thus obtained was 8.8 mm$^2$/s, and the specific gravity thereof was 0.91.

Note that, the weight average molecular weight, non-volatile component content, viscosity, and specific gravity were measured in the following manners.

General Formula (1)

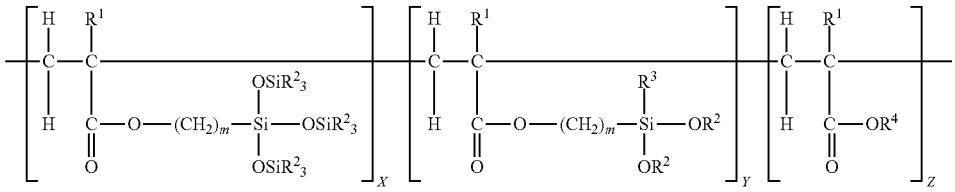

In the general formula (1), $R^1$ is a methyl group, $R^2$ is a methyl group, $R^3$ is a methyl group, $R^4$ is a methyl group, m is 3, and X, Y, and Z each represent a molar ratio, where X is 20 mol %, Y is 15 mol %, Z is 65 mol %, and (Y+Z)=80.

<Measuring Method of Non-Volatile Component Content>

The non-volatile component content was measured by sampling 1 g of the carrier coat resin on an aluminum dish, heating the sampled carrier coat resin at 150° C. for 1 hour, measuring a mass of the heated sample, and calculating using the following formula (3).

Non-volatile component content(%)=(mass before heating−mass after heating)×100/mass before heating Formula (3)<

<Measuring Method of Weight Average Molecular Weight>

The weight average molecular weight was obtained by a standard polystyrene conversion in accordance with gel permeation chromatography (GPC).

<Measuring Method of Viscosity>

The viscosity was measured at 25° C. in accordance with JIS-K2283.

<Measuring Method of Specific Gravity>

The specific gravity was measured at 25° C. in accordance with JIS-K0061.

Production Example C-1

Production of Electric Conductive Particle 1

After immersing tin oxide powder having the number average particle diameter of 0.02 μm in ethanol, the powder was heated in a nitrogen atmosphere, and subjected to a surface modification treatment by keeping the temperature at 250° C. for 1 hour, to thereby obtain Electric Conductive Particles 1.

The volume resistivity value and the number average particle diameter of Electric Conductive Particles 1 were measured in the following manners. The results are presented in Table 2.

<Measuring Method of Volume Resistivity Value>

Figure 9:
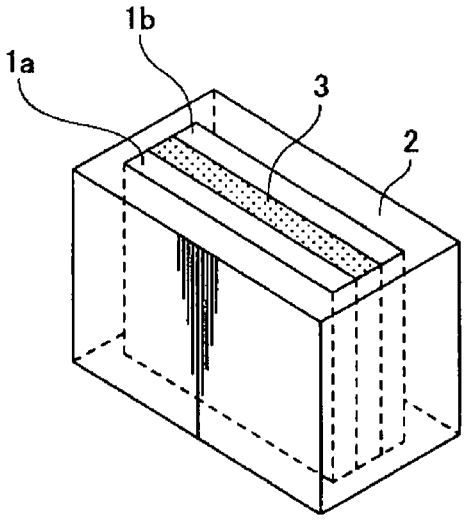
FIG. 9 is a perspective view illustrating one embodiment of a cell for use in the measurement of a volume resistivity value.
Figure 10:
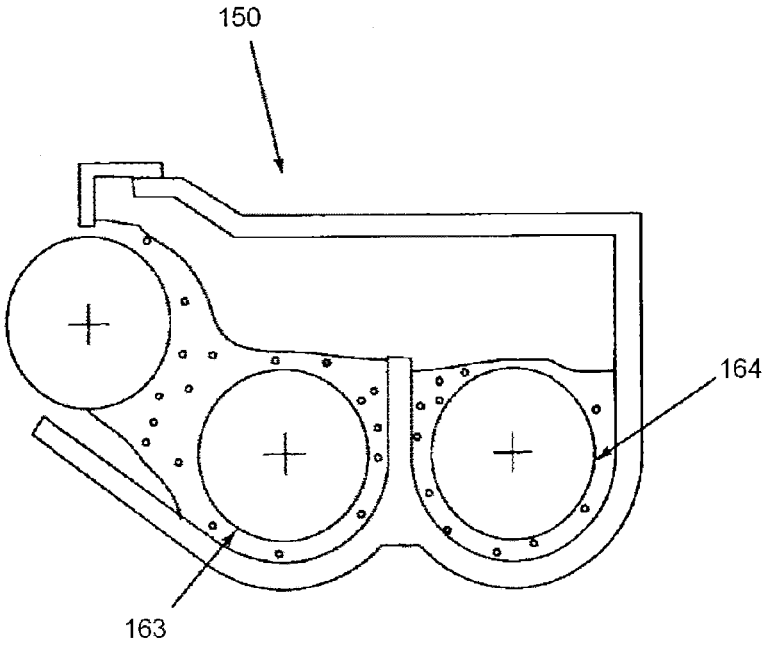
FIG. 10 is a schematic cross-sectional view of a developing unit of a conventional image forming apparatus.

The volume resistivity value (electric resistivity) was measured using a cell illustrated in FIG. 9. Specifically, a cell formed of a fluororesin container 2 to which electrodes 1*a* and 1*b* each having a surface area of 2.5 cm×4 cm had been provided to be apart from each other by 0.2 cm was packed with the powder 3, and tapping of the cell was performed 10 times with the falling height of 1 cm, and at the tapping speed of 30 times per minute. Next, DC voltage of 1,000 V was applied between the electrode 1*a* and the electrode 1*b*, and 30 seconds later, the value of resistance r [Ω] was measured by means of a high resistance meter 4329A (manufactured by Hewlett-Packard Japan, Ltd.), and the volume resistivity value was calculated from the following formula (4).

$$\text{Volume resistivity value}(\Omega\text{cm}) = r \times (2.5 \times 4)/0.2 \qquad \text{Formula (4)}$$

<Measuring Method of Number Average Particle Diameter>

The measurement of the primary particle diameter of the electric conductive particles was performed in the following manner.

A 100 mL container was charged with 10 mL of toluene, and to this, 1 mL of a sample to be measured (a dispersion liquid) was added, followed by stirring the mixture for 2 minutes by means of an ultrasonic cleaner. Subsequently, the particle diameter of the sample was measured by a laser diffraction/scattering particle size analyzer (product name: LA-950V2, manufactured by Horiba, Ltd.) under the following measuring conditions.

[Measuring Conditions]

Transmittance (blue bar): 85%±5%

Reflective index: powder for measurement (2.000), solvent (1.496)

Measuring method: batch-type cell measurement

Production Example C-2

Production of Electric Conductive Particle 2

Electric Conductive Particles 2 were obtained in the same manner as in Production Example C-1, provided that the tin oxide powder having the number average particle diameter of 0.02 μm was replaced with tin oxide powder having the number average particle diameter of 0.3 μm. The volume resistivity value and number average particle diameter of Electric Conductive Particles 2 were measured in the same manners as in Production Example C-1. The results are presented in Table 2.

Production Example C-3

Production of Electric Conductive Particle 3

In 1 L of water, 100 g of aluminum oxide powder having the number average particle diameter of 0.3 μm was dispersed, to thereby yield a suspension liquid. The obtained suspension liquid was heated to 70° C. To the heated suspension liquid, a solution prepared by dissolving 100 g of stannic chloride and 3 g of phosphorus pentoxide in 1 L of 2N hydrochloric acid, and 12% ammonia water were added dropwise over the period of 2 hours to thereby adjust pH of the suspension liquid to be in the range of 7 to 8. After the dripping, the suspension liquid was subjected to filtration, followed by washing to thereby obtain a cake. The obtained cake was dried at 110° C. The resulting dry powder was then treated at 500° C. for 1 hour in a nitrogen gas stream, to thereby obtain Electric Conductive Particles 3. The volume resistivity value and number average particle diameter of Electric Conductive Particles 3 were measured in the same manners as in Production Example C-1. The results are presented in Table 2.

Production Example C-4

Production of Electric Conductive Particle 4

In 1 L of water, 100 g of aluminum oxide powder having the number average particle diameter of 0.3 μm was dispersed, to thereby yield a suspension liquid. The obtained suspension liquid was heated to 70° C. To the heated suspension liquid, a solution prepared by dissolving 11.6 g of stannic chloride in 1 L of 2N hydrochloric acid, and 12% ammonia water were added dropwise over the period of 40 minutes to thereby adjust pH of the suspension liquid to be in the range of 7 to 8. Subsequently, to the resultant, a solution prepared by dissolving 36.7 g of indium chloride and 5.4 g of stannic chloride in 450 mL of 2N hydrochloric acid, and 12% ammonia water were added dropwise over the period of 1 hour to thereby adjust pH of the suspension liquid to be in the range of 7 to 8. After the dripping, the suspension liquid was subjected to filtration, followed by washing to thereby obtain a cake. The obtained cake was dried at 110° C. The resulting dry powder was then treated at 500° C. for 1 hour in a nitrogen gas stream, to thereby obtain Electric Conductive Particles 4. The volume resistivity value and number average particle diameter of Electric Conductive Particles 4 were measured in the same manners as in Production Example C-1. The results are presented in Table 2.

TABLE 2

| | Base | Volume specific resistance (Ω · cm) | Number average particle diameter (μm) |
|---|---|---|---|
| Electric conductive particle 1 | Tin oxide | 36 | 0.02 |
| Electric conductive particle 2 | Tin oxide | 30 | 0.02 |
| Electric conductive particle 3 | Aluminum oxide | 8 | 0.30 |
| Electric conductive particle 4 | Aluminum oxide | 4 | 0.30 |

Production Example D-1

Production of Carrier 1

After mixing 100 parts of a silicone resin solution (SR2411, manufactured by Dow Corning Toray Co., Ltd., solid content: 20% by mass) serving as Carrier Coat Resin 2, 30 parts of Electric Conductive Particles 1, 4 parts of titanium isopropoxybis(ethylacetoacetate) (TC-750, manufactured by Matsumoto Fine Chemical Co., Ltd.) serving as a catalyst, and 0.20 parts of amino silane (SH6020, manufactured by Dow Corning Toray Co., Ltd.), the resultant was diluted with toluene, to thereby obtain a resin solution having a solid content of 10%.

The obtained resin solution was applied onto a surface of Carrier Core 1 by means of a fluid bed coating device to provide a carrier coat layer having the average film thickness of 0.30 μm, and dried in the fluid tank whose temperature was controlled to 70° C. Next, the resultant was baked at 180° C. for 2 hours in an electric furnace, followed by cooling to room temperature (about 25° C.). The resultant was then cracked using a sieve having opening of 63 μm, to thereby obtain Carrier 1 having a carrier coat layer. The volume resistivity value of Carrier 1 was measured in the same manner as the measuring method thereof for the carrier core. The result is presented in Table 3. Note that, the film thickness of the carrier coat layer was measured in the following manner.

<Measuring Method of Film Thickness>

The average film thickness of the carrier coat layer was measured by observing cross-section of the carrier under transmission electron microscope (TEM).

Production Example D-2

Production of Carrier 2

Carrier 2 was obtained in the same manner as in Production Example D-1, provided that Carrier Core 1 was replaced with Carrier Core 4. The volume resistivity value of Carrier 2 was measured in the same manner as in Production Example D-1. The result is presented in Table 3.

Production Example D-3

Production of Carrier 3

Carrier 3 was obtained in the same manner as in Production Example D-1, provided that Carrier Core 1 was replaced with Carrier Core 4, and Electric Conductive Particles 1 were replaced with Electric Conductive Particles 2. The volume resistivity value of Carrier 3 was measured in the same manner as in Production Example D-1. The result is presented in Table 3.

Production Example D-4

Production of Carrier 4

Carrier 4 was obtained in the same manner as in Production Example D-1, provided that Carrier Core 1 was replaced with Carrier Core 3. The volume resistivity value of Carrier 4 was measured in the same manner as in Production Example D-1. The result is presented in Table 3.

Production Example D-5

Production of Carrier 5

Carrier 5 was obtained in the same manner as in Production Example D-4, provided that Electric Conductive Particles 1 were replaced with Electric Conductive Particles 2. The volume resistivity value of Carrier 5 was measured in the same manner as in Production Example D-1. The result is presented in Table 3.

Production Example D-6

Production of Carrier 6

Carrier 6 was obtained in the same manner as in Production Example D-4, provided that Electric Conductive Particles 1 were replaced with Electric Conductive Particles 3. The volume resistivity value of Carrier 6 was measured in the same manner as in Production Example D-1. The result is presented in Table 3.

Production Example D-7

Production of Carrier 7

Carrier 7 was obtained in the same manner as in Production Example D-4, provided that Electric Conductive Particles 1 were replaced with Electric Conductive Particles 4. The volume resistivity value of Carrier 7 was measured in the same manner as in Production Example D-1. The result is presented in Table 3.

Production Example D-8

Production of Carrier 8

After mixing 100 parts of Carrier Coat Resin 1 obtained in Production Example B-1, 37 parts of Electric Conductive Particles 4, 5 parts of titanium isopropoxybis(ethylacetoacetate) (TC-750, manufactured by Matsumoto Fine Chemical Co., Ltd.) serving as a catalyst, and 0.25 parts of amino silane (SH6020, manufactured by Dow Corning Toray Co., Ltd.), the resulting mixture was diluted with toluene, to thereby obtain a resin solution having a solid content of 10%.

The obtained resin solution was applied onto a surface of Carrier Core 3 by means of a fluid bed coating device to provide a carrier coat layer having the average film thickness of 0.30 μm, and dried in the fluid tank whose temperature was controlled to 70° C. Next, the resultant was baked at 180° C. for 2 hours in an electric furnace, followed by cooling to room temperature (about 25° C.). The resultant was then cracked using a sieve having opening of 63 μm, to thereby obtain Carrier 8 having a carrier coat layer. The volume resistivity value of Carrier 8 was measured in the same manner as in Production Example D-1. The result is presented in Table 3.

Note that, the average film thickness of the carrier coat layer was measured in the same manner as in Production Example D-1.

Production Example D-9

Production of Carrier 9

After mixing 10 parts of Carrier Coat Resin 1 obtained in Production Example B-1, 90 parts of a silicone resin solution (SR2411, manufactured by Dow Corning Toray Co., Ltd., solid content: 20% by mass) serving as Carrier Coat Resin 2, 32 parts of Electric Conductive Particles 4, 4 parts of titanium isopropoxybis(ethylacetoacetate) (TC-750, manufactured by Matsumoto Fine Chemical Co., Ltd.) serving as a catalyst, and 0.21 parts of amino silane (SH6020, manufactured by Dow Corning Toray Co., Ltd.), the resulting mixture was diluted with toluene, to thereby obtain a resin solution having a solid content of 10%.

The obtained resin solution was applied onto a surface of Carrier Core 3 by means of a fluid bed coating device to provide a carrier coat layer having the average film thickness of 0.30 μm, and dried in the fluid tank whose temperature was controlled to 70° C. Next, the resultant was baked at 180° C. for 2 hours in an electric furnace, followed by cooling to room temperature (about 25° C.). The resultant was then cracked using a sieve having opening of 63 μm, to thereby obtain Carrier 9 having a carrier coat layer. The volume resistivity value of Carrier 9 was measured in the same manner as in Production Example D-1. The result is presented in Table 3.

Note that, the average film thickness of the carrier coat layer was measured in the same manner as in Production Example D-1.

Production Example D-10

Production of Carrier 10

Carrier 10 was obtained in the same manner as in Production Example D-1, provided that Carrier Core 1 was replaced with Carrier Core 2. The volume resistivity value of Carrier 10 was measured in the same manner as in Production Example D-1. The result is presented in Table 3.

Production Example D-11

Production of Carrier 11

Carrier 11 was obtained in the same manner as in Production Example D-3, provided that Carrier Core 4 was replaced with Carrier Core 2. The volume resistivity value of Carrier 11 was measured in the same manner as in Production Example D-1. The result is presented in Table 3.

Production Example D-12

Production of Carrier 12

Carrier 12 was obtained in the same manner as in Production Example D-1, provided that Carrier Core 1 was replaced with Carrier Core 5. The volume resistivity value of Carrier 12 was measured in the same manner as in Production Example D-1. The result is presented in Table 3.

TABLE 3

| | | Carrier coat layer | | | |
|---|---|---|---|---|---|
| | Carrier core | Electric conductive particle | Carrier coat resin | Average thickness of carrier coat layer (μm) | Volume specific resistance Log (Ω · cm) |
| Carrier 1 | Carrier Core 1 | Electric Conductive Particle 1 | Carrier Coat Resin 2 | 0.30 | 14.8 |
| Carrier 2 | Carrier Core 4 | Electric Conductive Particle 1 | Carrier Coat Resin 2 | 0.30 | 14.7 |
| Carrier 3 | Carrier Core 4 | Electric Conductive Particle 2 | Carrier Coat Resin 2 | 0.30 | 14.9 |
| Carrier 4 | Carrier Core 3 | Electric Conductive Particle 1 | Carrier Coat Resin 2 | 0.30 | 14.7 |
| Carrier 5 | Carrier Core 3 | Electric Conductive Particle 2 | Carrier Coat Resin 2 | 0.30 | 15.0 |
| Carrier 6 | Carrier Core 3 | Electric Conductive Particle 3 | Carrier Coat Resin 2 | 0.30 | 14.1 |

TABLE 3-continued

| | | Carrier coat layer | | | |
|---|---|---|---|---|---|
| | Carrier core | Electric conductive particle | Carrier coat resin | Average thickness of carrier coat layer (μm) | Volume specific resistance Log (Ω · cm) |
| Carrier 7 | Carrier Core 3 | Electric Conductive Particle 4 | Carrier Coat Resin 2 | 0.30 | 14.2 |
| Carrier 8 | Carrier Core 3 | Electric Conductive Particle 4 | Carrier Coat Resin 1 | 0.30 | 14.5 |
| Carrier 9 | Carrier Core 3 | Electric Conductive Particle 4 | Carrier Coat Resin 1/ Carrier Coat Resin 2 | 0.30 | 14.3 |
| Carrier 10 | Carrier Core 2 | Electric Conductive Particle 1 | Carrier Coat Resin 2 | 0.30 | 14.8 |
| Carrier 11 | Carrier Core 2 | Electric Conductive Particle 2 | Carrier Coat Resin 2 | 0.30 | 14.9 |
| Carrier 12 | Carrier Core 5 | Electric Conductive Particle 1 | Carrier Coat Resin 2 | 0.30 | 14.2 |

Production Example E-1

Production of Toner 1

After sufficiently mixing toner materials of the following formula by means of HERSCHEL MIXER, the resulting mixture was melt-kneaded by means of a two-axial extrusion press, followed by rolling and cooling the kneaded product. After standing the kneaded product to cool, the kneaded product was roughly pulverized by a cutter mill, followed by finely pulverized by means of a jet micropulverizer. The resultant was classified by means of a wind classifier, to thereby obtain toner base particles having the weight average particle diameter of 7.4 μm.

To 100 parts of the obtained toner base particles, 1.0 part of hydrophobic silica particles (R972, manufactured by Nippon Aerosil Co., Ltd.) was added, and the resulting mixture was mixed by means of HERSCHEL MIXER, to thereby obtain Toner 1.

[Formula of Toner Materials]

| | |
|---|---|
| Polyester resin [manufactured by Kao Corporation, weight average molecular weight (Mw): 18,000, number average molecular weight (Mn): 4,000, glass transition temperature (Tg): 59° C., softening point: 120° C.] | 100 parts |
| Releasing agent (carnauba wax, manufactured by TOA KASEI CO., LTD.) | 5 parts |
| Carbon black (#44, manufactured by Mitsubishi Chemical Corporation) | 10 parts |
| Fluorine-containing quaternary ammonium salt | 4 parts |

Example 1

Image formation was performed by means of the image forming apparatus illustrated in FIG. 1, which was equipped with the stirring unit illustrated in FIGS. 3A and 3B, and the developing unit illustrated in FIG. 2 having the developing element illustrated in FIG. 5.

Specifically, with respect to 93 parts of Carrier 1 obtained in Production Example D-1, 7 parts of Toner 1 obtained in Production Example E-1 was added to the stirring unit 51, and stirred for 20 minutes to thereby prepare Developer 1 (two-component developer preparing process).

Next, the developer 1 stirred in the stirring unit 51 was discharged by the rotary feeder 53, and the discharged developer 1 was transported through the circulation path 56 by air pressure applied from the air pump 54 (transporting process). Then, running (developing) of a chart having an imaging area of 20% was performed on 100,000 sheets by the developing element 50 under the following conditions. Note that, the developer 1 was circulated during running, and the initial charged amount Q1, the initial volume resistivity value R1, and the initial flow energy amount in the stirring unit 51 were maintained.

[Developing Conditions]

Developing gap (between the photoconductor and developing sleeve): 0.3 mm

Doctor gap (between the developing sleeve and doctor): 0.65 mm

Linear velocity of photoconductor: 200 mm/sec (Linear velocity of developing sleeve)/(linear velocity of photoconductor): 1.80

Writing density: 600 dpi

Charge potential (Vd): −600V

Potential of a part of the photoconductor corresponding to an image part (a solid image) after exposure: −100V Developing bias: DC −500V/AC bias component: 2 KHz, −100 V to −900 V, 50% duty After the two-component developer preparing process, part of the developer 1 was collected from the stirring unit 51 before the transporting process, the developer was subjected to the measurements of the initial charged amount, initial volume resistivity value, and initial flow energy amount in the following manners.

Moreover, as for the transporting properties of the developer during running and durability of the developer after the running, variations in the charged amount and in resistance were evaluated in the following evaluation methods. The results are both presented in Tables 4-1 and 4-2.

<Measurements of Initial Charged Amount, Initial Volume Resistivity Value, and Initial Flow Energy Amount>

—Measuring Method of Initial Charged Amount of Developer—

The initial charged amount of the developer was measured by means of a blow-off device (TB-200, manufactured by KYOCERA Chemical Corporation [previously Toshiba Chemical Corporation]), and the measured value was determined as the initial charged amount Q1 of the developer.

—Measuring Method of Initial Volume Resistivity Value of Developer—

The initial volume resistivity value of the developer was measured in the same manner as the measuring method of the volume resistivity of the carrier core. The measured value was determined as the initial volume resistivity value R1 of the carrier.

—Measuring Method of Initial Flow Energy Amount of Developer—

The flow energy amount of the developer was measured by means of a powder rheometer (FT4, manufactured by Freeman Technology, Ltd.) in the following manner.

First, on a first cylindrical container having the inner diameter of 25 mm, height of 59 mm, and volume of 25 mL, a second cylindrical container having the inner diameter of 25 mm, and height of 22 mm was placed, to form a split container where the first container and the second container were separable. The split container was then charged with the developer.

Next, a rotary wing (blade having a diameter of 23.5 mm, manufactured by Freeman Technology, Ltd.) was set to the split container, which was then set to the powder rheometer. Then, the rotary wing was rotated in the clockwise direction when seen from the top (the direction vertical to the rotational axis) of the split container with the peripheral velocity of the top edge of the rotary wing being 40 mm/sec, and entering angle of the rotary wing being −5°, as well as moving the split container up and down in the direction parallel to the rotational axis, to thereby perform conditioning. This operation was performed 4 times in total.

After the conditioning, the top edge portion of the second container of the split container was slowly moved, and the developer was leveled off at the height, 59 mm, of the first container to thereby obtain the developer having the volume of 25 mL. The obtained developer was moved into a third container having the inner diameter of 25 mm, height of 80 mm, and the volume of 35 mL, which was used for the measurement. In the third container, the developer was subjected to conditioning once under the same conditions to the above (the peripheral velocity of the top edge of the rotary wing: 40 mm/sec, and entering angle of the rotary wing: −5°).

Next, a ventilation survey kit (manufactured by Freeman Technology, Ltd.) was provided to the bottom surface of the third container, and the rotary wing was rotated in the direction opposite to the rotational direction for the conditioning (anticlockwise direction as seen from the vertical direction with respect to the rotational axis) with the peripheral velocity of the top edge of the rotary wing being 100 mm/sec, and entering angle of the rotary wing being −10°, while ventilating the air at the rate of 0.8 mm/sec. Under the conditions above, the rotary wing was entered into the developer packed in the third container by the entry distance of 50 mm in the direction parallel to the rotational axis of the rotary wing (height direction of the third container), and the running torque and vertical load at the time of the entry were measured, from which the energy gradient (mJ/mm) relative to the entry distance was determined. The energy gradient was then integrated to obtain an area, which was determined as a flow energy amount.

Note that, a cycle of the conditioning and energy measuring operations were performed 5 times. The average value of the 5 measurements is presented in Tables 4-1 and 4-2.

<Evaluations of Transport Properties, Reduction in Charge Amount, Variation in Resistance of Developer>

—Evaluation on Transport Properties of Developer—

The transport properties of the developer were evaluated by confirming the number of formations of defected images due to lack of the developer in the developing element during the running for 100,000 sheets, and evaluating based on the following evaluation criteria.

[Evaluation Criteria]

A: The number of formations of defected image was 0 (no defected image was formed).

B: The number of formations of defected image was 1 to 10.

C: The number of formations of defected image was 11 or more.

Note that, A and B are acceptable.

—Evaluation on Reduction in Charge Amount—

To the carrier (93 parts) obtained by removing the toner from the developer after the running, 7 parts of Toner 1 obtained in Production Example E-1 was added, and the resulting developer was added to the stirring unit 51 illustrated in FIGS. 3A and 3B, and stirred for 20 minutes to charge the developer by frictions. The charged developer was measured by means of a blow-off device (TB-200, manufactured by KYOCERA Chemical Corporation [previously Toshiba Chemical Corporation]).

The initial charged amount of the developer was determined as Q1 and the charged amount of the developer after the running was determined as Q2, and a difference (Q1−Q2) was evaluated based on the following evaluation criteria.

[Evaluation Criteria]

A: The difference (Q1−Q2) was less than 5.

B: The difference (Q1−Q2) was in the range of 5 to 10.

C: The difference (Q1−Q2) was greater than 10.

Note that, A and B are acceptable.

—Evaluation on Variations in Resistance—

The carrier obtained by removing the toner from the developer after running by means of the blow-off device (TB-200, manufactured by KYOCERA Chemical Corporation [previously Toshiba Chemical Corporation]) was subjected to the measurement of the volume resistivity value in the same manner to the measuring method of the volume resistivity value of the carrier core.

The initial volume resistivity value of the carrier was determined as R1 and the volume resistivity value of the carrier after the running was determined as R2, and an absolute value (|Log R1−Log R2|) of a difference between common logarithms of these values was evaluated based on the following criteria.

[Evaluation Criteria]

A: The absolute value (|Log R1−Log R2|) was less than 2.

B: The absolute value (|Log R1−Log R2|) was in the range of 2 to 3.

C: The absolute value (|Log R1−Log R2|) was greater than 3.

Note that, A and B are acceptable.

Examples 2 to 9

Comparative Examples 1 to 3

Developers 2 to 12 of Examples 2 to 9 and Comparative Examples 1 to 3 were each produced in the same manner as in Example 1, provided that in the two-component developer preparing process, Carrier 1 obtained in Production Example D-1 was replaced with Carriers 2 to 11 obtained in Production Examples D-2 to D-11 respectively as presented in Tables 4-1 and 4-2, and subjected to a running (developing) in the same manner as in Example 1.

Developers 2 to 12 were subjected to the measurements of the initial charged amount of the developer, initial volume resistivity value of the developer, and flow energy amount of the developer in the same manners as in Example 1.

Moreover, in Examples 2 to 9 and Comparative Examples 1 to 3, as for the transporting properties of the developer during running and durability of the developer after the running, variations in the charged amount and in resistance were evaluated in the same manners as in Example 1. The results are both presented in Tables 4-1 and 4-2.

TABLE 4-1

| | | Formula of developer | | Initial developer | | |
|---|---|---|---|---|---|---|
| | Developer | Carrier | Toner | Charged amount Q1 (μC/g) | Volume specific resistivity R1 (Ω/cm) | Flow energy amount (mJ) |
| Ex. 1 | Developer 1 | Carrier 1 | Toner 1 | 24 | 14.8 | 38 |
| Ex. 2 | Developer 2 | Carrier 2 | Toner 1 | 22 | 14.7 | 32 |
| Ex. 3 | Developer 3 | Carrier 3 | Toner 1 | 23 | 14.9 | 34 |
| Ex. 4 | Developer 4 | Carrier 4 | Toner 1 | 25 | 14.7 | 47 |
| Ex. 5 | Developer 5 | Carrier 5 | Toner 1 | 24 | 15.0 | 52 |
| Ex. 6 | Developer 6 | Carrier 6 | Toner 1 | 31 | 14.1 | 53 |
| Ex. 7 | Developer 7 | Carrier 7 | Toner 1 | 30 | 14.2 | 51 |
| Ex. 8 | Developer 8 | Carrier 8 | Toner 1 | 45 | 14.5 | 53 |
| Ex. 9 | Developer 9 | Carrier 9 | Toner 1 | 36 | 14.3 | 52 |
| Comp. Ex. 1 | Developer 10 | Carrier 10 | Toner 1 | 25 | 14.8 | 22 |
| Comp. Ex. 2 | Developer 11 | Carrier 11 | Toner 1 | 23 | 14.9 | 28 |
| Comp. Ex. 3 | Developer 12 | Carrier 12 | Toner 1 | 16 | 14.2 | 75 |

TABLE 4-2

| | Evaluation | | |
|---|---|---|---|
| | Transport property of developer | Reduction in charge | Variation in resistance |
| Ex. 1 | B | A | B |
| Ex. 2 | B | A | B |
| Ex. 3 | B | A | B |
| Ex. 4 | A | A | B |
| Ex. 5 | A | A | B |
| Ex. 6 | A | A | B |
| Ex. 7 | A | A | B |
| Ex. 8 | A | B | A |
| Ex. 9 | A | A | A |
| Comp. Ex. 1 | C | B | B |
| Comp. Ex. 2 | C | B | B |
| Comp. Ex. 3 | B | C | C |

As understood from the results presented in Tables 4-1 and 4-2, the flow energy amount of the developer as measured by the powder rheometer was lower than 30 mJ in Comparative Examples 1 and 2, air leakage through the developer was caused because of the high flowability of the developer, and there were variations in the amount of the developer transported through the pipe in the transporting process. Therefore, the transporting property of the developer was not stable. By contrast, in Examples 1 to 9, the transporting property of the developer was stabilized as the flow energy amount as measured by the powder rheometer was 30 mJ to 70 mJ.

Since the flow energy amount as measured by the powder rheometer was greater than 70 mJ in Comparative Example 3, the charged amount was low, and the variation in the resistance was significant as the stress to the developer increased.

On the other hand, in Examples 1 to 9, occurrences of toner spent could be reduced by reducing the stress applied to the developer, which could prevent reduction in the charged amount.

Since the variations in the resistance were caused by abrasion of the coating film of the carrier, toner spend to the carrier, and detachment of particles from the coating film of the carrier, the variations in the resistance could be inhibited by reducing occurrences of toner spent.

The image forming method and image forming apparatus can prepare a developer of a constant density, in which a toner and a carrier are uniformly mixed, effectively provide an appropriate charge amount without providing stress to the developer, and continuously, stably and effectively transport a constant amount of the developer to a developing element. Therefore, the image forming method and image forming apparatus of the present invention can be used in various fields, and can be suitably used especially in electrophotographic image formation, such as by a printer and a photocopier.

For example, the embodiments of the present invention include as follows:

<1> An image forming method, containing:

charging a latent electrostatic image bearing member;

forming a latent electrostatic image on the charged latent electrostatic image bearing member;

developing the latent electrostatic image formed on the latent electrostatic image bearing member with a two-component developer by a developing element to form a visible image, where the two-component developer contains a toner and a carrier, and where the developing contains: stirring the toner and the carrier to prepare the two-component developer to have a flow energy amount of 30 mJ to 70 mJ; and periodically discharging the stirred two-component developer and transporting the two-component developer to the developer unit by air pressure to thereby supply the two-component developer for the developing;

transferring the visible image to a recording medium; and fixing the transferred visible image onto the recording medium by a fixing member, wherein the flow energy amount is a total energy amount attained from a sum of running torque and vertical load as measured by a powder rheometer containing a ventilation unit and a rotary wing, when the rotary wing rotates and enters the two-component developer packed in a container by 50 mm in the direction parallel to a rotational axis of the rotary wing with the top edge of the rotary wing having a peripheral velocity of 100 mm/sec, and the rotary wing having an entering angle of −10°, while ventilating at a ventilating rate of 0.8 mm/sec.

<2> The image forming method according to <1>, wherein the two-component developer has the flow energy amount of 40 mJ to 70 mJ.

<3> The image forming method according to any of <1> or <2>, wherein the carrier contains carrier particles, each carrier particle containing a core, wherein the cores have a shape factor SF-2 of 130 to 160.

<4> The image forming method according to any one of <1> to <3>, wherein the carrier contains carrier particles, each of which contains a core and a carrier coat layer containing a carrier coat resin, provided on a surface of the core, wherein the carrier coat layer contains filler having the average particle diameter of 0.1 μm to 0.5 μm.

<5> The image forming method according to <4>, wherein the filler is electric conductive particles each containing a base and an electric conductive coating layer formed on a surface of the base, where the base contains alumina.

<6> The image forming method according to any of <4> or <5>, wherein the carrier coat resin is a silicone resin.

<7> The image forming method according to any one of <4> to <6>, wherein the carrier coat resin contains a copolymer represented by the general formula (1):

General Formula (1)

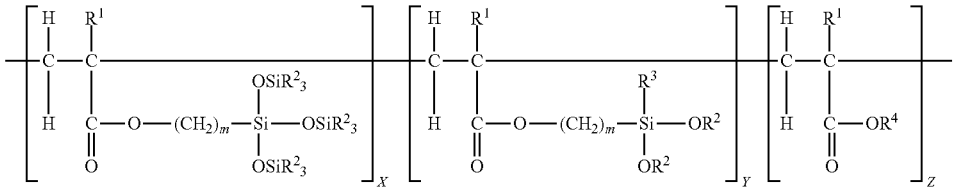

where $R^1$ is a hydrogen atom or a methyl group; $R^2$ is a C1-C4 alkyl group; $R^3$ is a C1-C8 alkyl group or a C1-C4 alkoxy group; $R^4$ is a C1-C4 aliphatic hydrocarbon group or an alkyl group; m is an integer of 1 to 8; X, Y, and Z are each a molar ratio, where X is 10 mol % to 90 mol %, Y is 10 mol % to 90 mol %, Z is 30 mol % to 80 mol %, and a sum of Y and Z is greater than 60 mol % but lower than 90 mol %.

<8> An image forming apparatus, containing:

a charging unit configured to charge a latent electrostatic image bearing member;

a latent electrostatic image forming unit configured to form a latent electrostatic image on the charged latent electrostatic image bearing member;

a developer unit containing a two-component developer preparing element, a transporting element, and a developing element, where the two component developer preparing element is configured to stir a toner and a carrier constituting a two-component developer to give the two-component developer having a flow energy amount of 30 mJ to 70 mJ, the transporting element is configured to periodically discharge the stirred two-component developer, and transport the two-component developer to the developing element by air pressure, and the developing element is configured to develop the latent electrostatic image formed on the latent electrostatic image bearing member with the transported two-component developer to form a visible image;

a transferring unit configured to transfer the visible image to a recording medium; and a fixing unit containing a fixing member, and configured to fix the transferred visible image onto the recording medium by the fixing member, wherein the flow energy amount is a total energy amount attained from a sum of running torque and vertical load as measured by a powder rheometer containing a ventilation unit and a rotary wing, when the rotary wing rotates and enters the two-component developer packed in a container by 50 mm in the direction parallel to a rotational axis of the rotary wing with the top edge of the rotary wing having a peripheral velocity of 100 mm/sec, and the rotary wing having an entering angle of −10°, while ventilating at a ventilating rate of 0.8 mm/sec.

This application claims priority to Japanese application No. 2011-156768, filed on Jul. 15, 2011, and incorporated herein by reference.

What is claimed is:

1. An image forming method, comprising:

charging a latent electrostatic image bearing member;

forming a latent electrostatic image on the charged latent electrostatic image bearing member;

developing the latent electrostatic image formed on the latent electrostatic image bearing member with a two-component developer by a developing element to form a visible image, where the two-component developer contains a toner and a carrier, and where the developing contains: stirring the toner and the carrier to prepare the two-component developer to have a flow energy amount of 30 mJ to 70 mJ; and periodically discharging the stirred two-component developer and transporting the two-component developer to the developer unit by air pressure to thereby supply the two-component developer for the developing;

transferring the visible image to a recording medium; and fixing the transferred visible image onto the recording medium by a fixing member, wherein the flow energy amount is a total energy amount attained from a sum of running torque and vertical load as measured by a powder rheometer containing a ventilation unit and a rotary wing, when the rotary wing rotates and enters the two-component developer packed in a container by 50 mm in the direction parallel to a rotational axis of the rotary wing with the top edge of the rotary wing having a peripheral velocity of 100 mm/sec, and the rotary wing having an entering angle of −10°, while ventilating at a ventilating rate of 0.8 mm/sec.

2. The image forming method according to claim 1, wherein the two-component developer has the flow energy amount of 40 mJ to 70 mJ.

3. The image forming method according to claim 1, wherein the carrier contains carrier particles, each carrier particle containing a core, wherein the cores have a shape factor SF-2 of 130 to 160.

4. The image forming method according to claim 1, wherein the carrier contains carrier particles, each of which contains a core and a carrier coat layer containing a carrier coat resin, provided on a surface of the core, wherein the carrier coat layer contains filler having the average particle diameter of 0.1 μm to 0.5 μm.

5. The image forming method according to claim 4, wherein the filler is electric conductive particles each containing a base and an electric conductive coating layer formed on a surface of the base, where the base contains alumina.

6. The image forming method according to claim 4, wherein the carrier coat resin is a silicone resin.

7. The image forming method according to claim 4, wherein the carrier coat resin contains a copolymer represented by the general formula (1):

General Formula (1)

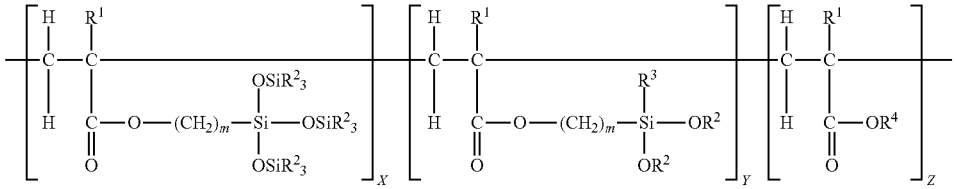

where $R^1$ is a hydrogen atom or a methyl group; $R^2$ is a C1-C4 alkyl group; $R^3$ is a C1-C8 alkyl group or a C1-C4 alkoxy group; $R^4$ is a C1-C4 aliphatic hydrocarbon group or an alkyl group; m is an integer of 1 to 8; X, Y, and Z are each a molar ratio, where X is 10 mol % to 90 mol %, Y is 10 mol % to 90 mol %, Z is 30 mol % to 80 mol %, and a sum of Y and Z is greater than 60 mol % but lower than 90 mol %.

8. An image forming apparatus, comprising:

a charging unit configured to charge a latent electrostatic image bearing member;

a latent electrostatic image forming unit configured to form a latent electrostatic image on the charged latent electrostatic image bearing member;

a developer unit containing a two-component developer preparing element, a transporting element, and a developing element, where the two component developer preparing element is configured to stir a toner and a carrier constituting a two-component developer to give the two-component developer having a flow energy amount of 30 mJ to 70 mJ, the transporting element is configured to periodically discharge the stirred two-component developer, and transport the two-component developer to the developing element by air pressure, and the developing element is configured to develop the latent electrostatic image formed on the latent electrostatic image bearing member with the transported two-component developer to form a visible image;

a transferring unit configured to transfer the visible image to a recording medium; and a fixing unit containing a fixing member, and configured to fix the transferred visible image onto the recording medium by the fixing member, wherein the flow energy amount is a total energy amount attained from a sum of running torque and vertical load as measured by a powder rheometer containing a ventilation unit and a rotary wing, when the rotary wing rotates and enters the two-component developer packed in a container by 50 mm in the direction parallel to a rotational axis of the rotary wing with the top edge of the rotary wing having a peripheral velocity of 100 mm/sec, and the rotary wing having an entering angle of −10°, while ventilating at a ventilating rate of 0.8 mm/sec.

* * * * *